US009651317B2

(12) United States Patent
Jindou et al.

(10) Patent No.: US 9,651,317 B2
(45) Date of Patent: May 16, 2017

(54) HEAT EXCHANGER AND AIR CONDITIONER

(75) Inventors: Masanori Jindou, Osaka (JP); Yoshio Oritani, Osaka (JP); Hirokazu Fujino, Osaka (JP); Toshimitsu Kamada, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 859 days.

(21) Appl. No.: 13/980,639

(22) PCT Filed: Jan. 23, 2012

(86) PCT No.: PCT/JP2012/000385

§ 371 (c)(1),
(2), (4) Date: Jul. 19, 2013

(87) PCT Pub. No.: WO2012/098917

PCT Pub. Date: Jul. 26, 2012

(65) Prior Publication Data

US 2013/0306285 A1 Nov. 21, 2013

(30) Foreign Application Priority Data

Jan. 21, 2011 (JP) ..... 2011-011300

(51) Int. Cl.
*F28F 9/02* (2006.01)
*F25B 39/00* (2006.01)
(Continued)

(52) U.S. Cl.
CPC ..... *F28F 9/02* (2013.01); *F25B 39/00* (2013.01); *F28D 1/05391* (2013.01);
(Continued)

(58) Field of Classification Search
CPC .... F25B 39/028; F25B 39/04; F28D 1/05375; F28F 9/0275
(Continued)

(56) References Cited

U.S. PATENT DOCUMENTS 4,121,656 A 10/1978 Huber
5,203,407 A * 4/1993 Nagasaka ..... F28D 1/05375 165/174
(Continued)

FOREIGN PATENT DOCUMENTS

DE 19515527 A1 * 10/1996 ..... B60H 1/3227
EP 0762072 A2 3/1997
(Continued)

*Primary Examiner* — Allen Flanigan
(74) *Attorney, Agent, or Firm* — Birch, Stewart, Kolasch & Birch, LLP

(57) ABSTRACT

A first header collecting pipe is divided into an upper space corresponding to an upper heat exchange region and a lower space corresponding to a lower heat exchange region. The lower space is divided into a plurality of communication spaces corresponding respectively to auxiliary heat exchange parts of the lower heat exchange region. A second header collecting pipe is divided into a communication space corresponding to both of a first main heat exchange part and the third auxiliary heat exchange part, and into communication spaces corresponding respectively to other main heat exchange parts and the other auxiliary heat exchange parts. Each of pairs of communication space and communication space is connected to an associated one of communication pipes.

9 Claims, 17 Drawing Sheets

(51) Int. Cl.
*F28D 1/053* (2006.01)
*F28F 1/12* (2006.01)
*F28D 21/00* (2006.01)

(52) U.S. Cl.
CPC ..... *F28F 1/126* (2013.01); *F28F 9/0209* (2013.01); *F28F 9/0275* (2013.01); *F28D 2021/0068* (2013.01); *F28F 2215/12* (2013.01); *F28F 2250/06* (2013.01)

(58) Field of Classification Search
USPC ..... 165/151, 174; 62/525, 526
See application file for complete search history.

(56) References Cited

U.S. PATENT DOCUMENTS 5,752,566 A * 5/1998 Liu et al. ..... F25B 39/04 165/110
5,910,167 A * 6/1999 Reinke et al. ..... F25B 39/028 165/174
5,988,267 A * 11/1999 Park et al. ..... F25B 39/04 165/110
6,382,310 B1 * 5/2002 Smith ..... F28F 9/26 165/121
6,769,269 B2 * 8/2004 Oh et al. ..... F25B 39/04 62/507
7,448,436 B2 * 11/2008 Katoh et al. ..... F25B 39/02 165/110
8,910,488 B2 * 12/2014 Fung ..... A47F 3/0443 62/256
2008/0202738 A1 * 8/2008 Nelson et al. ..... F25B 39/028 165/174
2008/0308264 A1 * 12/2008 Antonijevic ..... F28D 1/05375 165/165
2009/0120627 A1 5/2009 Beamer et al.
2010/0089095 A1 * 4/2010 Macri et al. ..... F25B 39/028 62/525
2010/0206535 A1 8/2010 Munoz et al.

FOREIGN PATENT DOCUMENTS

EP 1426714 A1 6/2004
JP 06074609 A * 3/1994
JP 2003-222436 A 8/2003
JP 2004-218983 A 8/2004
JP 2005-3223 A 1/2005
JP 2007-120899 A 5/2007
JP 2009-503427 A 1/2009
JP 2010-112581 A 5/2010
KR 1999-0040066 A 6/1999
WO WO 03/025477 A1 3/2003

* cited by examiner

HEAT EXCHANGER AND AIR CONDITIONER

TECHNICAL FIELD

The present disclosure relates to a heat exchanger which includes a pair of header collecting pipes and a plurality of flat tubes connected to the header collecting pipes and which is configured to exchange heat between fluid flowing through the flat tube and air, and to an air conditioner including the heat exchanger.

BACKGROUND ART

Conventionally, a heat exchanger has been known, which includes a pair of header collecting pipes and a plurality of flat tubes connected to the header collecting pipes. Patent Documents 1 and 2 disclose the heat exchangers of this type. Specifically, in each of the heat exchangers described in Patent Documents 1 and 2, the header collecting pipes stand upright respectively at right and left ends of the heat exchanger, and the plurality of flat tubes are arranged so as to extend from the first header collecting pipe to the second header collecting pipe. Moreover, each of the heat exchangers described in Patent Documents 1 and 2 exchanges heat between refrigerant flowing inside the flat tube and air flowing outside the flat tube.

In each of the heat exchangers described in Patent Documents 1 and 2, the following is repeated: a flow of refrigerant in the heat exchanger branches into some of the flat tubes, and then such flows of refrigerant from the flat tubes are joined together. That is, a flow of refrigerant into the first header collecting pipe branches into some of the flat tubes extending toward the second header collecting pipe. After passing through the flat tubes, the flows of refrigerant are joined together at the second header collecting pipe. Then, the flow of refrigerant re-branches into the other flat tubes extending back to the first header collecting pipe.

CITATION LIST

Patent Document

PATENT DOCUMENT 1: Japanese Patent Publication No. 2005-003223

PATENT DOCUMENT 2: Japanese Patent Publication No. 2010-112581

SUMMARY OF THE INVENTION

Technical Problem

In each of the foregoing heat exchangers described in Patent Documents 1 and 2, there is a disadvantage that, if the number of flat tubes is increased in order to increase the amount of circulating refrigerant, the length of the header collecting pipe increases, and therefore a sufficient condenser performance cannot be realized. If the heat exchanger functions as a condenser, liquid refrigerant is accumulated in the header collecting pipe at which flows of refrigerant from the flat tubes are joined together. Thus, the lower the flat tube is positioned, the more liquid refrigerant is accumulated. For such a reason, the lower the flat tube is positioned, the lower the flow rate of gas refrigerant flowing into the flat tube is. Thus, the sufficient condenser performance cannot be realized.

For the foregoing reason, in order to increase the amount of circulating refrigerant, a plurality of heat exchangers described in Patent Documents 1 and 2 may be stacked on each other to form an integral heat exchanger. However, in such a case, there are a plurality of points at each of which an upstream flat tube through which refrigerant first flows in one of the heat exchangers and a downstream flat tube through which refrigerant last flows in the other one of the heat exchangers are adjacent each other. In the heat exchanger, the refrigerant temperature of the upstream flat tube and the refrigerant temperature of the downstream flat tube are significantly different from each other. If such flat tubes are adjacent to each other, heat is transferred between the flat tubes, and the amount of heat exchange between refrigerant and air decreases accordingly. Thus, a so-called "heat loss" is caused. Due to the heat loss, a heat exchange efficiency of the heat exchanger is lowered.

The present disclosure has been made in view of the foregoing, and it is an objective of the present disclosure to reduce, in a heat exchanger in which a plurality of flat tubes connect between two header collecting pipes, a heat loss due to heat transfer between adjacent ones of the flat tubes and to reduce lowering of a heat exchange efficiency.

Solution to the Problem

A first aspect of the invention is intended for a heat exchanger including a first header collecting pipe (60) and a second header collecting pipe (70) each standing upright; a plurality of flat tubes (33) which are arranged one above the other such that side surfaces thereof face each other, which are each connected to the first header collecting pipe (60) at one end and connected to the second header collecting pipe (70) at the other end, and which are each formed with a passage (34) of refrigerant; and a plurality of fins (36) each configured to divide part of the heat exchanger between adjacent ones of the flat tubes (33) into a plurality of air passages (38) through each of which air flows.

The flat tubes (33) are divided for an upper heat exchange region (51) divided into a plurality of heat exchange parts arranged one above the other, and a lower heat exchange region (52) divided into one or more heat exchange parts arranged one above the other. An internal space of the first header collecting pipe (60) is divided into an upper space (61) which is for gas refrigerant and which corresponds to the upper heat exchange region (51), and a lower space (62) which is for liquid refrigerant and which corresponds to the lower heat exchange region (52). In the lower space (62) of the first header collecting pipe (60), one or more communication spaces corresponding respectively to the one or more heat exchange parts are formed such that the one or more communication spaces are as many as the one or more heat exchange parts. An internal space of the second header collecting pipe (70) is divided such that communication spaces corresponding respectively to the heat exchange parts of the upper heat exchange region (51) are formed such that the communication spaces are as many as the heat exchange parts, and one or more communication spaces corresponding respectively to the one or more heat exchange parts of the lower heat exchange region (52) are formed such that the one or more communication spaces are as many as the one or more heat exchange parts. Each communication space corresponding to the upper heat exchange region (51) communicates with an associated one of the one or more communication spaces corresponding to the lower heat exchange region (52).

In the heat exchanger (23) of the first aspect of the invention, the flat tubes (33) of the upper heat exchange region (51) are laterally divided for a plurality of heat exchange parts, and the flat tubes (33) of the lower heat exchange region (52) are laterally divided for one or more heat exchange parts. For example, the case where each of the upper heat exchange region (51) and the lower heat exchange region (52) is divided into the plurality of heat exchange parts will be described herein.

For example, liquid refrigerant (refrigerant in a liquid single-phase state or a gas-liquid two-phase state) flowing into each of the communication spaces of the lower space (62) of the first header collecting pipe (60) from the outside flows through the flat tubes (33) of an associated one of the heat exchange parts of the lower heat exchange region (52), and then flows into an associated one of the communication spaces of the second header collecting pipe (70) corresponding to the lower heat exchange region (52). In such a state, while flowing through the flat tubes (33), the refrigerant exchanges heat with air. In the second header collecting pipe (70), the refrigerant flowing into each of the communication spaces corresponding to the lower heat exchange region (52) flows into an associated one of the communication spaces corresponding to the upper heat exchange region (51). Then, the refrigerant flows into each of the heat exchange parts of the upper heat exchange region (51). While flowing through the flat tubes (33), the refrigerant flowing into each of the heat exchange parts further exchanges heat with air. The refrigerant flowing through each of the heat exchange parts of the upper heat exchange region (51) is changed into gas refrigerant, and the gas refrigerant flows out from the upper space (61) of the first header collecting pipe (60) to the outside. As in the foregoing, in the heat exchanger (23) of the present disclosure, liquid refrigerant (refrigerant in a liquid single-phase state or a gas-liquid two-phase state) flowing into the lower space (62) of the first header collecting pipe (60) from the outside flows through the heat exchange parts arranged one above the other in the lower heat exchange region (52). Subsequently, the refrigerant flows through the heat exchange parts arranged one above the other in the upper heat exchange region (51), and is evaporated. Then, the refrigerant flows to the outside. Moreover, gas refrigerant flowing into the upper space (61) of the first header collecting pipe (60) from the outside flows through the heat exchange parts of the upper heat exchange region (51). Subsequently, the refrigerant flows through the heat exchange parts of the lower heat exchange region (52), and is condensed. Then, the refrigerant flows to the outside.

The temperature of refrigerant flowing through each of the heat exchange parts of the upper heat exchange region (51) and the temperature of refrigerant flowing through each of the heat exchange parts of the lower heat exchange region (52) are significantly different from each other. If the heat exchange parts having different refrigerant temperatures are adjacent to each other, heat transfer occurs between adjacent ones of the flat tubes (33) of such heat exchange parts, resulting in a so-called "heat loss." In the heat exchanger (23) of the present disclosure, although the plurality of heat exchange parts of the upper heat exchange region (51) and the plurality of heat exchange parts of the lower heat exchange region (52) which are different from the heat exchange parts of the upper heat exchange region (51) in refrigerant temperature are provided, the number of parts where the heat exchange part of the upper heat exchange region (51) and the heat exchange part of the lower heat exchange region (52) are adjacent to each other is the minimum of one part. That is, in the heat exchanger (23) of the present disclosure, the part where the heat exchange parts of the upper heat exchange region (51) and the lower heat exchange region (52) are adjacent to each other is only part where the heat exchange part positioned lowermost in the upper heat exchange region (51) and the heat exchange part positioned uppermost in the lower heat exchange region (52) are adjacent to each other.

A second aspect of the invention is intended for the heat exchanger of the first aspect of the invention, in which the upper heat exchange region (51) and the lower heat exchange region (52) are each divided into the heat exchange parts (51*a*-51*c*, 52*a*-52*c*) such that the heat exchange parts (51*a*-51*c*) of the upper heat exchange region (51) are as many as the one or more heat exchange parts (52*a*-52*c*) of the lower heat exchange region (52). The internal space of the second header collecting pipe (70) is divided such that some (71*a*, 71*b*, 71*d*, 71*e*) of the communication spaces corresponding respectively to some heat exchange parts (51*b*, 51*c*, 52*a*, 52*b*) other than a lowermost one (51*a*) of the heat exchange parts of the upper heat exchange region (51) and an uppermost one (52*c*) of the heat exchange parts of the lower heat exchange region (52) are formed such that the some (71*a*, 71*b*, 71*d*, 71*e*) of the communication spaces are as many as the some heat exchange parts (51*b*, 51*c*, 52*a*, 52*b*), and the other one (71*c*) of the communication spaces corresponding to both of the lowermost one (51*a*) of the heat exchange parts of the upper heat exchange region (51) and the uppermost one (52*c*) of the heat exchange parts of the lower heat exchange region (52) is formed. In the second header collecting pipe (70), some (71*d*, 71*e*) of the communication spaces corresponding respectively to some heat exchange parts (51*b*, 51*c*) other than the lowermost one (51*a*) of the heat exchange parts of the upper heat exchange region (51) are each paired with an associated one of the other ones (71*a*, 71*b*) of the communication spaces corresponding respectively to some heat exchange parts (52*a*, 52*b*) other than the uppermost one (52*c*) of the heat exchange parts of the lower heat exchange region (52), and a communication pipe (72, 73) connecting between each pair of communication spaces is provided.

In the second aspect of the invention, e.g., liquid refrigerant (refrigerant in a liquid single-phase state or a gas-liquid two-phase state) flowing into each of the communication spaces of the lower space (62) of the first header collecting pipe (60) from the outside flows into an associated one of the heat exchange parts (52*a*-52*c*) of the lower heat exchange region (52). The refrigerant flowing through the heat exchange part (52*c*) positioned uppermost in the lower heat exchange region (52) flows into the communication space (71*c*) of the second header collecting pipe (70), and then flows into the heat exchange part (52*a*) positioned lowermost in the upper heat exchange region (51). Meanwhile, the refrigerant flowing through the heat exchange part (52*a*, 52*b*) other than the heat change part (52*c*) positioned uppermost in the lower heat exchange region (52) flows into an associated one of the communication spaces (71*a*, 71*b*) of the second header collecting pipe (70). Then, the refrigerant flows into the other communication space (71*d*, 71*e*) of the second header collecting pipe (70) through an associated one of the communication pipes (72, 73). The refrigerant flowing into the communication space (71*d*, 71*e*) flows into an associated one of the heat exchange parts (51*b*, 51*c*) other than the heat exchange part (51*a*) positioned lowermost in the upper heat exchange region (51). In the heat exchanger (23) of the present disclosure, the part where the heat exchange parts (51*a*-51*c*, 52*a*-52*c*) of the upper heat exchange region (51) and the lower heat exchange region (52) having different refrigerant temperatures are adjacent to each other is only part where the heat exchange part (51*a*) positioned lowermost in the upper heat exchange region (51) and the heat exchange part (52*c*) positioned uppermost in the lower heat exchange region (52) are adjacent to each other.

A third aspect of the invention is intended for the heat exchanger of the first aspect of the invention, in which the upper heat exchange region (51) is divided into the heat exchange parts (51*a*-51*c*), and the lower heat exchange region (52) forms the heat exchange part (52*a*). The internal space of the second header collecting pipe (70) is divided such that the communication spaces (71*a*-71*d*) corresponding respectively to the heat exchange parts (51*a*-51*c*, 52*a*) of the upper heat exchange region (51) and the lower heat exchange region (52) are formed such that the communication spaces (71*a*-71*d*) are as many as the heat exchange parts (51*a*-51*c*, 52*a*). In the second header collecting pipe (70), a communication member (75) branching into some (71*b*-71*d*) of the communication spaces corresponding respectively to the heat exchange parts (51*a*-51*c*) of the upper heat exchange region (51) from the other one (71*a*) of the communication spaces corresponding to the heat exchange part (52*a*) of the lower heat exchange region (52) is provided.

In the third aspect of the invention, e.g., liquid refrigerant (refrigerant in a liquid single-phase state or a gas-liquid two-phase state) flowing into the lower space (62) of the first header collecting pipe (60) from the outside flows through the heat exchange part (52*a*) of the lower heat exchange region (52), and then flows into the communication space (71*a*) of the second header collecting pipe (70). The refrigerant flowing into the communication space (71*a*) is distributed to the other communication spaces (71*b*-71*d*) of the second header collecting pipe (70) through the communication member (75). The refrigerant distributed to the communication space (71*b*-71*d*) flows into an associated one of the heat exchange parts (51*a*-51*c*) of the upper heat exchange region (51). In the heat exchanger (23) of the present disclosure, the part where the heat exchange parts (51*a*-51*c*, 52*a*) of the upper heat exchange region (51) and the lower heat exchange region (52) having different refrigerant temperatures are adjacent to each other is only part where the heat exchange part (51*a*) positioned lowermost in the upper heat exchange region (51) and the heat exchange part (52*a*) of the lower heat exchange region (52) are adjacent to each other.

A fourth aspect of the invention is intended for the heat exchanger of the first aspect of the invention, in which the upper heat exchange region (51) and the lower heat exchange region (52) are each divided into the heat exchange parts (51*a*-51*c*, 52*a*-52*c*) such that the heat exchange parts (51*a*-51*c*) of the upper heat exchange region (51) are as many as the heat exchange parts (52*a*-52*c*) of the lower heat exchange region (52). The internal space of the second header collecting pipe (70) is divided such that each heat exchange part (51*a*-51*c*) of the upper heat exchange region (51) is paired with an associated one of the heat exchange parts (52*a*-52*c*) of the lower heat exchange region (52), and the communication spaces (71*a*-71*c*) corresponding respectively to the pairs of heat exchange parts are formed such that the communication spaces (71*a*-71*c*) are as many as the pairs of heat exchange parts.

In the fourth aspect of the invention, e.g., liquid refrigerant (refrigerant in a liquid single-phase state or a gas-liquid two-phase state) flowing into each of the communication spaces of the lower space (62) of the first header collecting pipe (60) from the outside flows through an associated one of the heat exchange parts (52*a*-52*c*) of the lower heat exchange region (52), and then flows into an associated one of the communication spaces (71*a*-71*c*) of the second header collecting pipe (70). The refrigerant flowing into the communication space (71*a*-71*c*) flows into an associated one of the heat exchange parts (51*a*-51*c*) of the upper heat exchange region (51). In the heat exchanger (23) of the present disclosure, the part where the heat exchange parts (51*a*-51*c*, 52*a*-52*c*) of the upper heat exchange region (51) and the lower heat exchange region (52) having different refrigerant temperatures are adjacent to each other is only part where the heat exchange part (51*a*) positioned lowermost in the upper heat exchange region (51) and the heat exchange part (52*c*) positioned uppermost in the lower heat exchange region (52) are adjacent to each other.

A fifth aspect of the invention is intended for the heat exchanger of any one of the first to fourth aspects of the invention, in which the upper space (61) of the first header collecting pipe (60) is a single space corresponding to all of the heat exchange parts (51*a*-51*c*) of the upper heat exchange region (51). In the first header collecting pipe (60), a gas connection member (85) connected to the upper space (61) at a position close to an upper end of the upper space (61) and a liquid connection member (80, 86) connected to each communication space of the lower space (62) at a position close to a lower end of the each communication space.

In the fifth aspect of the invention, in, e.g., the case where the heat exchanger (23) functions as a condenser, gas refrigerant sent to the heat exchanger (23) flows into part of the upper space (61) of the first header collecting pipe (60) close to the upper end of the upper space (61) through the gas connection member (85). Subsequently, the gas refrigerant in the upper space (61) is distributed to the heat exchange parts (51*a*-51*c*) of the upper heat exchange region (51). The refrigerant flowing through the heat exchange part (51*a*-51*c*) of the upper heat exchange region (51) passes through an associated one of the heat exchange parts (52*a*-52*c*) of the lower heat exchange region (52) and the lower space (62) of the first header collecting pipe (60) in this order, and then flows into the liquid connection member (80, 86). On the other hand, in the case where the heat exchanger (23) functions as an evaporator, liquid refrigerant (refrigerant in a liquid single-phase state or gas-liquid two-phase state) sent to the heat exchanger (23) flows into part of the lower space (62) of the first header collecting pipe (60) close to the lower end of the lower space (62) through the liquid connection member (80, 86), and then flows into the heat exchange part (52*a*-52*c*) of the lower heat exchange region (52). The refrigerant flowing through the heat exchange part (52*a*-52*c*) of the lower heat exchange region (52) passes through an associated one of the heat exchange parts (51*a*-51*c*) of the upper heat exchange region (51) and the upper space (61) of the first header collecting pipe (60) in this order, and then flows into the gas connection member (85).

A sixth aspect of the invention is intended for the heat exchanger of any one of the first to fifth aspects of the invention, in which a heat transfer reduction structure (57) configured to reduce heat transfer from one of adjacent ones of the flat tubes (33) to the other one of the adjacent ones of the flat tubes (33) is provided between the adjacent ones of the flat tubes (33) which are adjacent to each other across a boundary (55) between adjacent ones of the heat exchange parts of the upper heat exchange region (51) and the lower heat exchange region (52).

In the sixth aspect of the invention, the heat transfer reduction structure (57) is provided in the only part where the heat exchange parts of the upper heat exchange region (51) and the lower heat exchange region (52) are adjacent to each other. Thus, the heat transfer reduction structure (57) blocks heat transfer between the flat tubes (33) of the upper heat exchange region (51) and the lower heat exchange region (52) which are adjacent to each other. Consequently, in the heat exchanger (23) of the present disclosure, the amount of heat to be transferred from refrigerant flowing through one of adjacent flat tubes (33) to refrigerant flowing through the other flat tube (33) is further reduced.

A seventh aspect of the invention is intended for an air conditioner including a refrigerant circuit (20) including the heat exchanger (23) of any one of the first to sixth aspect of the invention. Refrigerant circulates through the refrigerant circuit (20) to perform a refrigeration cycle.

In the seventh aspect of the invention, the heat exchanger (23) of any one of the first to sixth aspects of the invention is connected to the refrigerant circuit (20). In the heat exchanger (23), refrigerant circulating through the refrigerant circuit (20) flows through the passages (34) of the flat tubes (33), and exchanges heat with air flowing through the air passages (38).

Advantages of the Invention

According to the first to fourth aspects of the invention, in the heat exchanger (23), the plurality of heat exchange parts of the upper heat exchange region (51) are arranged so as to be concentrated on one side (upper side) of the heat exchanger (23) in the vertical direction, and the one or more heat exchange parts of the lower heat exchange region (52) are arranged so as to be concentrated on the opposite side (lower side) of the heat exchanger (23) in the vertical direction. Thus, the number of parts where the heat exchange parts of the upper heat exchange region (51) and the lower heat exchange region (52) having different refrigerant temperatures are adjacent to each other can be reduced to the minimum of one part. Consequently, a heat loss due to heat transfer between the flat tubes (33) of the upper heat exchange region (51) and the lower heat exchange region (52) which are adjacent to each other can be reduced as much as possible. As a result, lowering of a heat exchange efficiency of the heat exchanger (23) can be significantly reduced.

According to the fifth aspect of the invention, in the first header collecting pipe (60), the liquid connection member (80, 86) communicates with each of the communication spaces at the lower end thereof in the lower space (62). Thus, if the heat exchanger (23) functions as the condenser, it can be ensured that high-density liquid refrigerant is sent from each of the communication spaces of the lower space (62) to the liquid connection member (80, 86). Moreover, in the first header collecting pipe (60) of the fifth aspect of the invention, the gas connection member (85) communicates with the upper space (61), which is a single space, at the upper end thereof. Thus, if the heat exchanger (23) functions as the evaporator, it can be ensured that low-density gas refrigerant is sent from the upper space (61) to the gas connection member (85).

According to the sixth aspect of the invention, since the heat transfer reduction structure (57) is provided between the flat tubes (33) which are vertically adjacent to each other across the boundary (55) between the heat exchange parts of the upper heat exchange region (51) and the lower heat exchange region (52), heat transfer between the adjacent flat tubes (33) can be blocked. That is, in the heat exchanger (23) of the present disclosure, heat transfer can be reduced even at the only part where the heat exchange parts of the upper heat exchange region (51) and the lower heat exchange region (52) are adjacent to each other. Thus, the lowering of the heat exchange efficiency of the heat exchanger (23) can be further reduced.

According to the seventh aspect of the invention, the air conditioner (10) for which the foregoing advantages can be realized can be provided.

DESCRIPTION OF EMBODIMENTS

Embodiments of the present disclosure will be described below in detail with reference to drawings. Note that the embodiments and variations described below will be set forth merely for the purpose of preferred examples in nature, and are not intended to limit the scope, applications, and use of the invention.

First Embodiment of the Invention

A first embodiment of the present disclosure will be described. A heat exchanger of the present embodiment is an outdoor heat exchanger (23) provided in an air conditioner (10).

Air Conditioner

Figure 1:
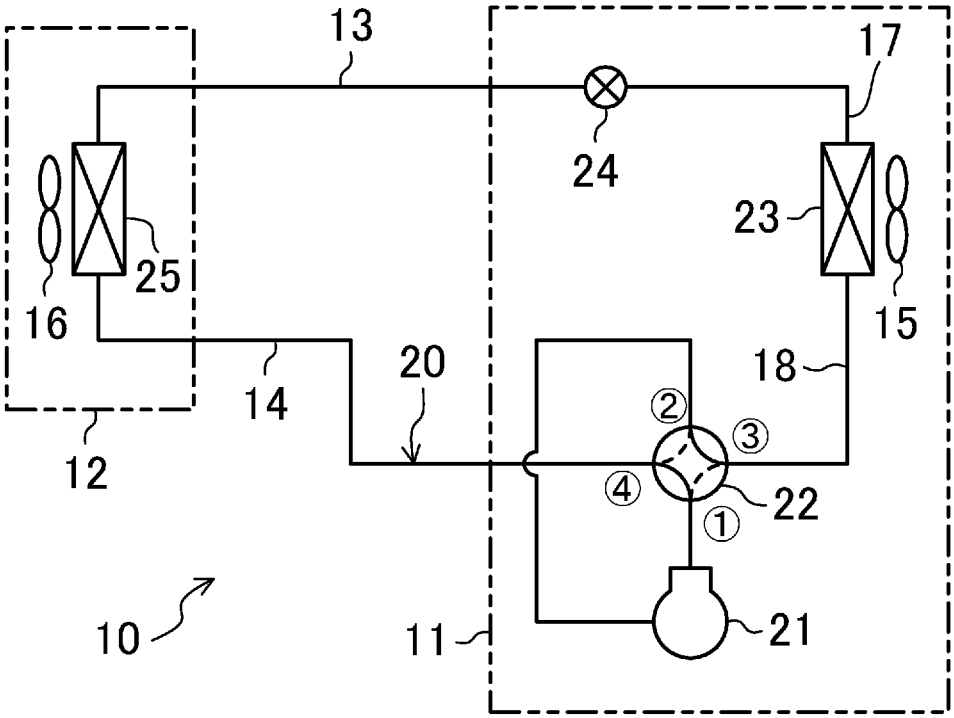
FIG. 1 is a refrigerant circuit diagram illustrating a schematic configuration of an air conditioner including an outdoor heat exchanger of a first embodiment.

The air conditioner (10) will be described with reference to FIG. 1.

<Configuration of Air Conditioner>

The air conditioner (10) includes an outdoor unit (11) and an indoor unit (12). The outdoor unit (11) and the indoor unit (12) are connected together through a liquid communication pipe (13) and a gas communication pipe (14). In the air conditioner (10), a refrigerant circuit (20) is formed by the outdoor unit (11), the indoor unit (12), the liquid communication pipe (13), and the gas communication pipe (14).

The refrigerant circuit (20) is provided with a compressor (21), a four-way valve (22), the outdoor heat exchanger (23), an expansion valve (24), and an indoor heat exchanger (25). The compressor (21), the four-way valve (22), the outdoor heat exchanger (23), and the expansion valve (24) are accommodated in the outdoor unit (11). In the outdoor unit (11), an outdoor fan (15) configured to supply outdoor air to the outdoor heat exchanger (23) is provided. On the other hand, the indoor heat exchanger (25) is accommodated in the indoor unit (12). In the indoor unit (12), an indoor fan (16) configured to supply indoor air to the indoor heat exchanger (25) is provided.

The refrigerant circuit (20) is a closed circuit filled with refrigerant. In the refrigerant circuit (20), the compressor (21) is, on an outlet side thereof, connected to a first port of the four-way valve (22), and is, on an inlet side thereof; connected to a second port of the four-way valve (22). Moreover, in the refrigerant circuit (20), the outdoor heat exchanger (23), the expansion valve (24), and the indoor heat exchanger (25) are arranged in this order from a third port to a fourth port of the four-way valve (22).

The compressor (21) is a hermetic scroll compressor or a hermetic rotary compressor. The four-way valve (22) switches between a first state (state indicated by a dashed line in FIG. 1) in which the first port communicates with the third port and the second port communicates with the fourth port and a second state (state indicated by a solid line in FIG. 1) in which the first port communicates with the fourth port and the second port communicates with the third port. The expansion valve (24) is a so-called "electronic expansion valve."

The outdoor heat exchanger (23) is configured to exchange heat between outdoor air and refrigerant. The outdoor heat exchanger (23) will be described later. On the other hand, the indoor heat exchanger (25) is configured to exchange heat between indoor air and refrigerant. The indoor heat exchanger (25) is a so-called "cross-fin type fin-and-tube heat exchanger" including heat transfer pipes which are circular pipes.

<Operation of Air Conditioner>

The air conditioner (10) selectively performs an air-cooling operation and an air-heating operation.

In the refrigerant circuit (20) during the air-cooling operation, a refrigeration cycle is performed in the state in which the four-way valve (22) is set at the first state. In such a state, refrigerant circulates through the outdoor heat exchanger (23), the expansion valve (24), and the indoor heat exchanger (25) in this order. Moreover, the outdoor heat exchanger (23) functions as a condenser, and the indoor heat exchanger (25) functions as an evaporator. In the outdoor heat exchanger (23), gas refrigerant flowing from the compressor (21) is condensed by dissipating heat to outdoor air, and the condensed refrigerant flows out to the expansion valve (24).

In the refrigerant circuit (20) during the air-heating operation, the refrigeration cycle is performed in the state in which the four-way valve (22) is set at the second state. In such a state, refrigerant circulates through the indoor heat exchanger (25), the expansion valve (24), and the outdoor heat exchanger (23) in this order. Moreover, the indoor heat exchanger (25) functions as the condenser, and the outdoor heat exchanger (23) functions as the evaporator. Refrigerant expanded into gas-liquid two-phase refrigerant upon passage through the expansion valve (24) flows into the outdoor heat exchanger (23). The refrigerant flowing into the outdoor heat exchanger (23) is evaporated by absorbing heat from outdoor air, and then flows out to the compressor (21).

Outdoor Heat Exchanger

The outdoor heat exchanger (23) will be described with reference to FIGS. 2-4. Note that the number of flat tubes (33) described below will be set forth merely for the purpose of examples.

<Configuration of Outdoor Heat Exchanger>

Figure 2:
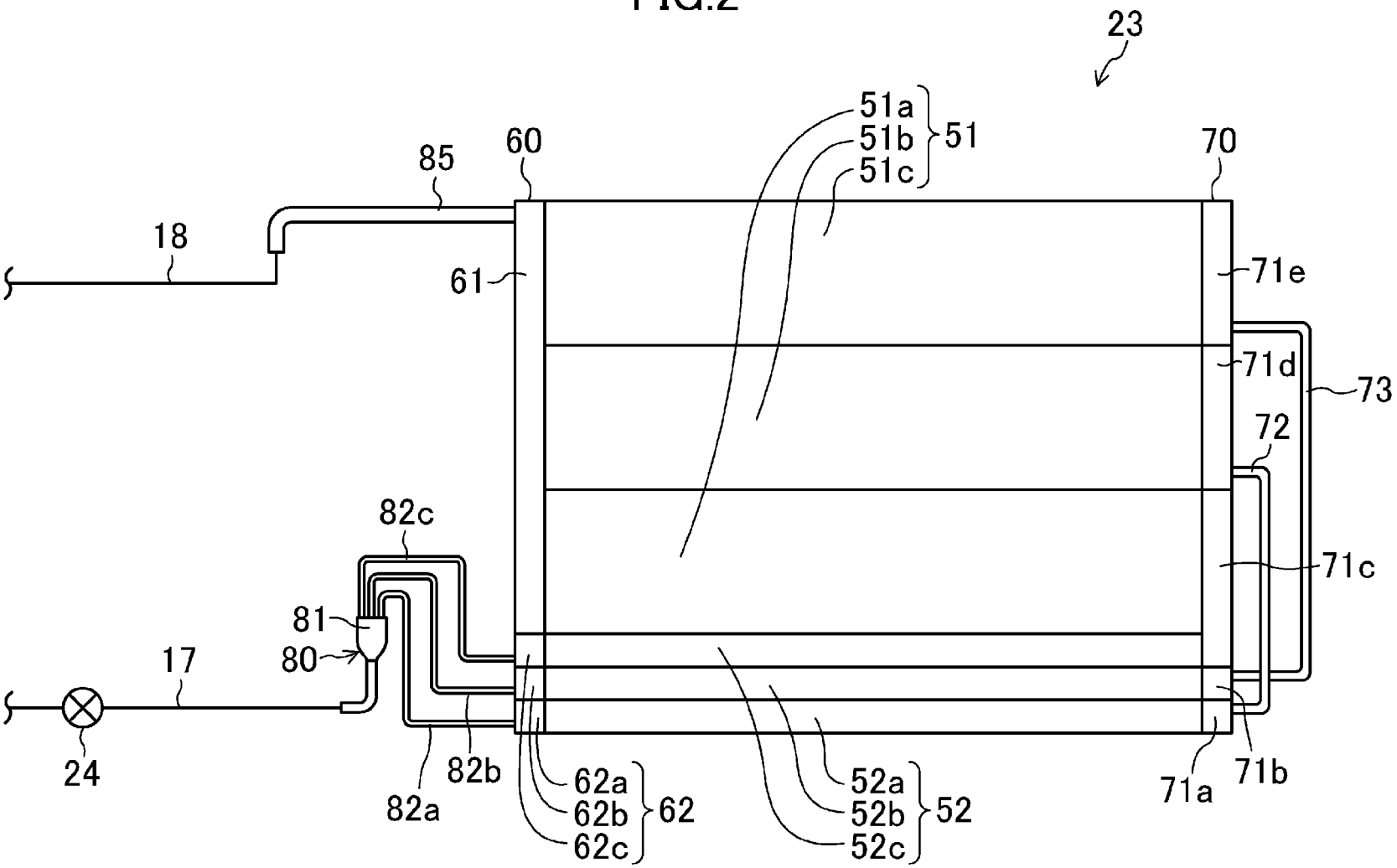
FIG. 2 is a front view illustrating a schematic configuration of the outdoor heat exchanger of the first embodiment.
Figure 3:
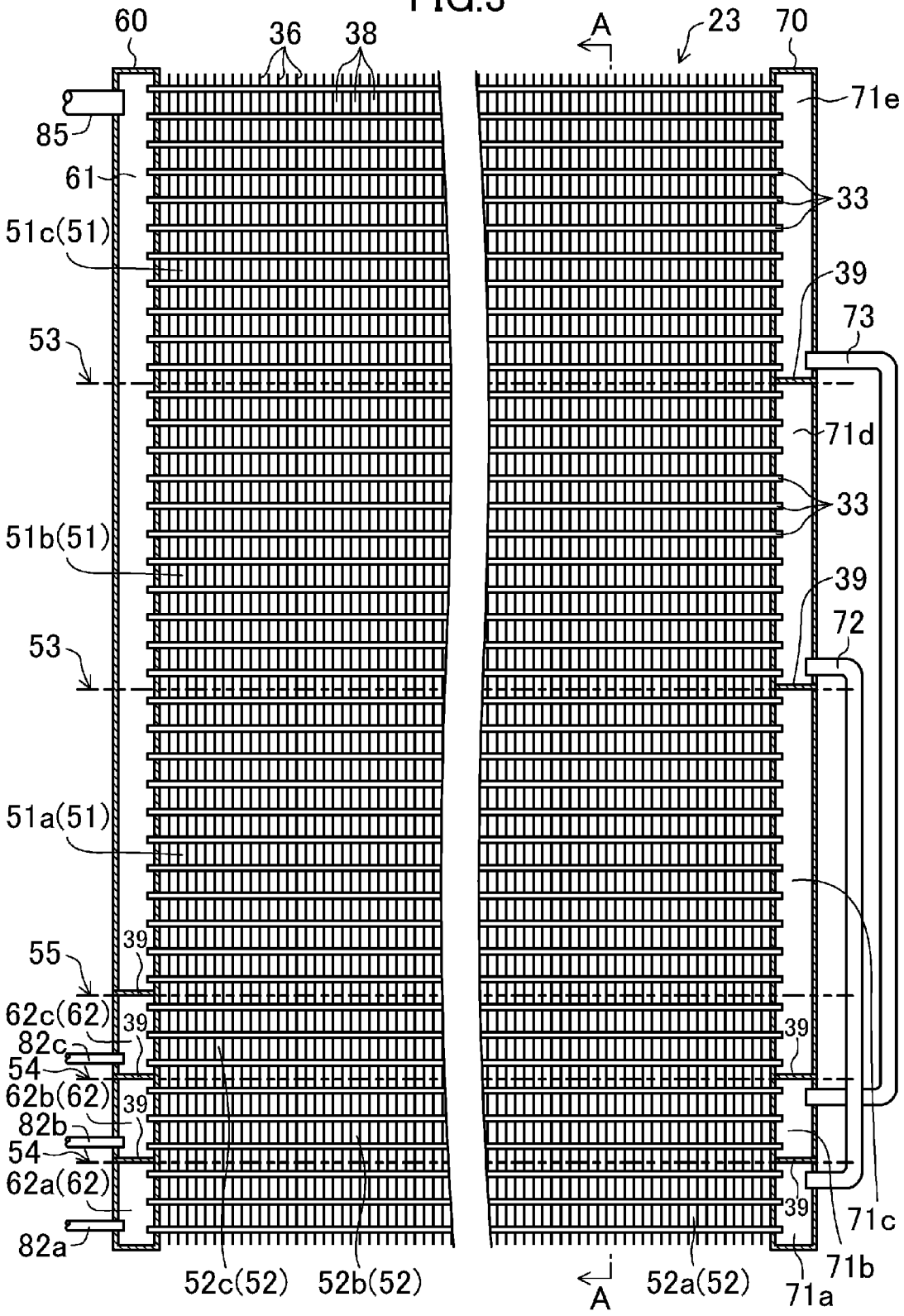
FIG. 3 is a partial cross-sectional view illustrating a front side of the outdoor heat exchanger of the first embodiment.

Referring to FIGS. 2 and 3, the outdoor heat exchanger (23) includes a single first header collecting pipe (60), a single second header collecting pipe (70), a plurality of flat tubes (33), and a plurality of fins (36). The first header collecting pipe (60), the second header collecting pipe (70), the flat tubes (33), and the fins (36) are members made of an aluminum alloy, and are joined together by brazing.

The first header collecting pipe (60) and the second header collecting pipe (70) are each formed in an elongated hollow cylindrical shape closed at both ends thereof. In FIGS. 2 and 3, the first header collecting pipe (60) stands upright at a left end of the outdoor heat exchanger (23), and the second header collecting pipe (70) stands upright at a right end of the outdoor heat exchanger (23). That is, the first header collecting pipe (60) and the second header collecting pipe (70) are arranged such that axial directions thereof are along the vertical direction.

Figure 4:
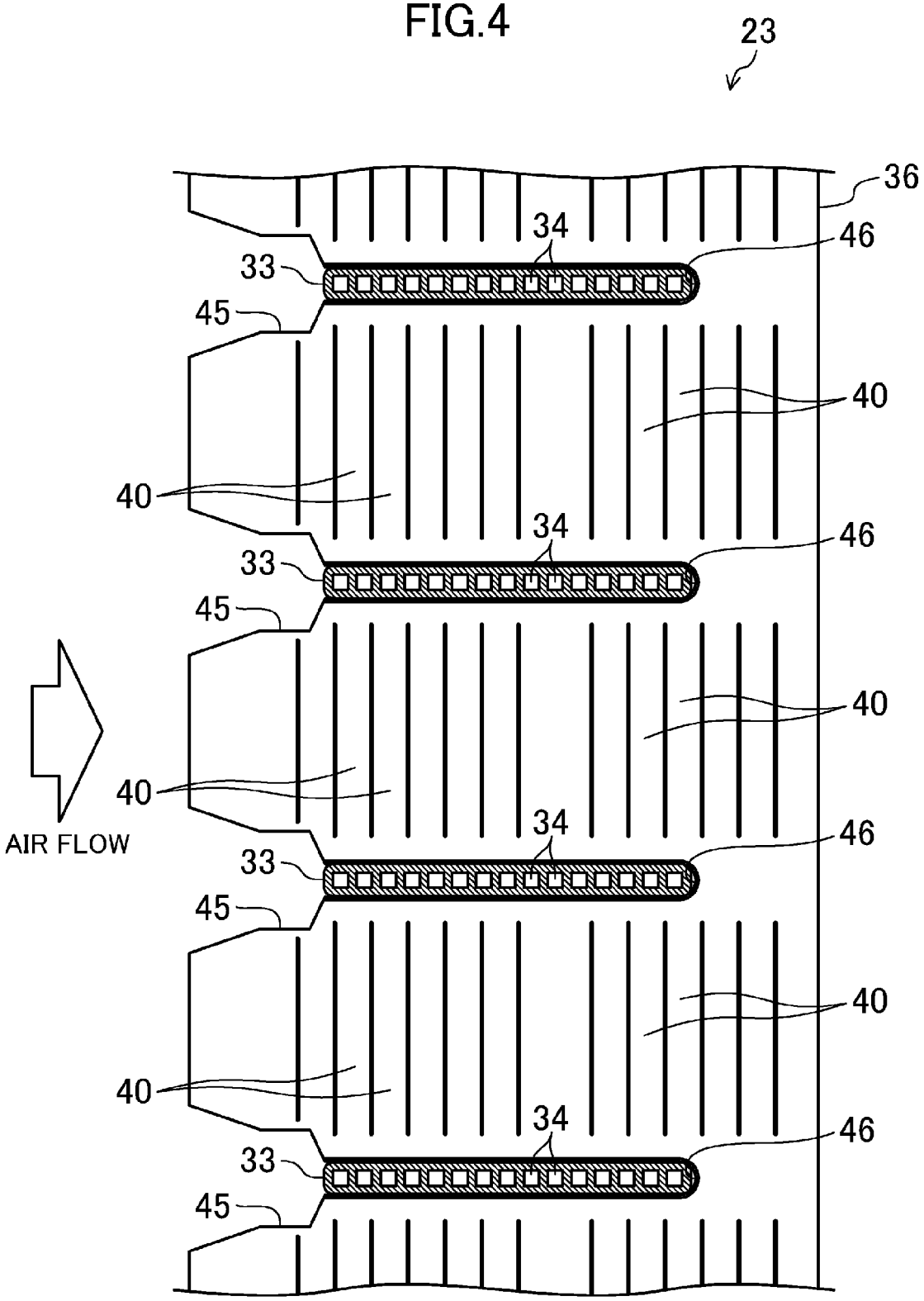
FIG. 4 is a partial cross-sectional view of the heat exchanger along an A-A line illustrated in FIG. 3.

Referring to FIG. 4, the flat tube (33) is a heat transfer pipe having a flat oval cross section or a rounded rectangular cross section. In the outdoor heat exchanger (23), the flat tubes (33) are arranged such that extension directions thereof are along a lateral direction and that flat side surfaces thereof face each other. Moreover, the flat tubes (33) are arranged at predetermined intervals in the vertical direction, and the extension directions of the flat tubes (33) are substantially parallel to each other. Referring to FIG. 3, the flat tube (33) is, at one end thereof, inserted into the first header collecting pipe (60), and is, at the other end thereof, inserted into the second header collecting pipe (70).

Referring to FIG. 4, a plurality of fluid passages (34) are formed in the flat tube (33). The fluid passage (34) is a passage extending in the extension direction of the flat tube (33). In the flat tube (33), the fluid passages (34) are arranged in line in a width direction of the flat tube (33) perpendicular to the extension direction thereof. Each of the fluid passages (34) formed in the flat tube (33) communicates, at one end thereof, with an internal space of the first header collecting pipe (60), and communicates, at the other end thereof, with an internal space of the second header collecting pipe (70). While flowing through each of the fluid passages (34) of the flat tubes (33), refrigerant supplied to the outdoor heat exchanger (23) exchanges heat with air.

Referring to FIG. 4, the fin (36) is an vertically-elongated plate-shaped fin formed in such a manner that a metal plate is pressed. In the fin (36), a plurality of elongated cut parts (45) extending from a front edge (i.e., a windward-side edge part) of the fin (36) in a width direction thereof are formed. In the fin (36), the cut parts (45) are formed at predetermined intervals in a longitudinal direction of the fin (36) (i.e., in the vertical direction). Part of the cut part (45) on a leeward side forms a pipe insertion part (46). The pipe insertion part (46) has a vertical width substantially equal to the thickness of the flat tube (33) and a length substantially equal to the width of the flat tube (33). The flat tube (33) is inserted into the pipe insertion part (46) of the fin (36), and is joined to a peripheral edge part of the pipe insertion part (46) by brazing. Moreover, in the fin (36), louvers (40) each configured to accelerate heat transfer are formed. The fins (36) are arranged in the extension direction of the flat tube (33) to divide part of the outdoor heat exchanger (23) between adjacent ones of the flat tubes (33) into a plurality of air passages (38) through each of which air flows.

Referring to FIG. 2, the flat tubes (33) of the outdoor heat exchanger (23) are divided for two upper and lower heat exchange regions (51, 52). That is, the outdoor heat exchanger (23) is formed with the upper heat exchange region (51) and the lower heat exchange region (52). The heat exchange region (51, 52) is laterally divided into three heat exchange parts (51*a*-51*c*, 52*a*-52*c*). Specifically, in the upper heat exchange region (51), the first main heat exchange part (51*a*), the second main heat exchange part (51*b*), and the third main heat exchange part (51*c*) are formed in this order from the bottom to the top. In the lower heat exchange region (52), the first auxiliary heat exchange part (52*a*), the second auxiliary heat exchange part (52*b*), and the third auxiliary heat exchange part (52*c*) are formed in this order from the bottom to the top. As described above, in the outdoor heat exchanger (23) of the present embodiment, the upper heat exchange region (51) and the lower heat exchange region (52) are each divided into the plurality of heat exchange parts (51*a*-51*c*, 52*a*-52*c*) such that the number of heat exchange parts (51*a*-51*c*, 52*a*-52*c*) is the same between the upper heat exchange region (51) and the lower heat exchange region (52). Referring to FIG. 3, the main heat exchange part (51*a*-51*c*) includes eleven flat tubes (33), and the auxiliary heat exchange part (52*a*-52*c*) includes three flat tubes (33). Thus, as shown in FIGS. 2 and 3, the number of flat tubes connected to a communication space (71*d* or 71*e*) of the second header collecting pipe 70 corresponding to the upper heat exchange region 51 is larger than the number of flat tubes connected with the associated one (71*a* or 71*b*, respectively) of the plurality of communication spaces of the second header collecting pipe corresponding to the lower heat exchange region 52. Note that the number of heat exchange parts (51*a*-51*c*, 52*a*-52*c*) formed in the heat exchange region (51, 52) may be two or may be equal to or greater than four.

Each of the internal spaces of the first header collecting pipe (60) and the second header collecting pipe (70) is laterally divided by a plurality of partition plates (39).

Specifically, the internal space of the first header collecting pipe (60) is divided into an upper space (61) which is for gas refrigerant and corresponds to the upper heat exchange region (51) and a lower space (62) which is for liquid refrigerant and corresponds to the lower heat exchange region (52). Note that the "liquid refrigerant" described herein means refrigerant in a liquid single-phase state or refrigerant in a gas-liquid two-phase state. The upper space (61) is a single space corresponding to all of the main heat exchange parts (51*a*-51*c*). That is, the upper space (61) communicates with all of the flat tubes (33) of the main heat exchange parts (51*a*-51*c*). The lower space (62) is laterally divided into communication spaces (62*a*-62*c*) corresponding respectively to the auxiliary heat exchange parts (52*a*-52*c*) such that the number of communication spaces (62*a*-62*c*) is the same (e.g., three) as the number of auxiliary heat exchange parts (52*a*-52*c*). That is, in the lower space (62), the first communication space (62*a*) communicating with the flat tubes (33) of the first auxiliary heat exchange part (52*a*), the second communication space (62*b*) communicating with the flat tubes (33) of the second auxiliary heat exchange part (52*b*), and the third communication space (62*c*) communicating with the flat tubes (33) of the third auxiliary heat exchange part (52*c*) are formed.

The internal space of the second header collecting pipe (70) is laterally divided into five communication spaces (71*a*-71*e*). Specifically, the internal space of the second header collecting pipe (70) is divided into four communication spaces (71*a*, 71*b*, 71*d*, 71*e*) corresponding respectively to the main heat exchange parts (51*b*, 51*c*) and the auxiliary heat exchange parts (52*a*, 52*b*) other than the first main heat exchange part (51*a*) positioned lowermost in the upper heat exchange region (51) and the third auxiliary heat exchange part (52*c*) positioned uppermost in the lower heat exchange region (52), and into a single communication space (71*c*) corresponding to both of the first main heat exchange part (51*a*) and the third auxiliary heat exchange part (52*c*). That is, in the internal space of the second header collecting pipe (70), the first communication space (71*a*) communicating with the flat tubes (33) of the first auxiliary heat exchange part (52*a*), the second communication space (71*b*) communicating with the flat tubes (33) of the second auxiliary heat exchange part (52*b*), the third communication space (71*c*) communicating with the flat tubes (33) of both of the third auxiliary heat exchange part (52*c*) and the first main heat exchange part (51*a*), the fourth communication space (71*d*) communicating with the flat tubes (33) of the second main heat exchange part (51*b*), and the fifth communication space (71*e*) communicating with the flat tubes (33) of the third main heat exchange part (51*c*) are formed.

In the second header collecting pipe (70), the fourth communication space (71*d*) and the fifth communication space (71*e*) are paired respectively with the first communication space (71*a*) and the second communication space (71*b*). Specifically, the first communication space (71*a*) and the fourth communication space (71*d*) are paired together, and the second communication space (71*b*) and the fifth communication space (71*e*) are paired together. Moreover, in the second header collecting pipe (70), a first communication pipe (72) connecting between the first communication space (71*a*) and the fourth communication space (71*d*) and a second communication pipe (73) connecting between the second communication space (71*b*) and the fifth communication space (71*e*) are provided. That is, in the outdoor heat exchanger (23) of the present embodiment, the first main heat exchange part (51*a*) and the third auxiliary heat exchange part (52*c*) are paired together, the second main heat exchange part (51*b*) and the first auxiliary heat exchange part (52*a*) are paired together, and the third main heat exchange part (51*c*) and the second auxiliary heat exchange part (52*b*) are paired together.

As described above, in the internal space of the second header collecting pipe (70), the communication spaces (71*c*, 71*d*, 71*e*) corresponding respectively to the main heat exchange parts (51*a*-51*c*) of the upper heat exchange region (51) are formed such that the number of communication spaces (71*c*, 71*d*, 71*e*) is the same (e.g., three) as the number of main heat exchange parts (51*a*-51*c*). Moreover, the communication spaces (71*a*, 71*b*, 71*c*) corresponding respectively to the auxiliary heat exchange parts (52*a*-52*c*) of the lower heat exchange region (52) are formed such that the number of communication spaces (71*a*, 71*b*, 71*c*) is the same (e.g., three) as the number of auxiliary heat exchange parts (52*a*-52*c*). Further, the communication space (71*c*, 71*d*, 71*e*) corresponding to the upper heat exchange region (51) and the communication space (71*a*, 71*b*, 71*c*) corresponding to the lower heat exchange region (52) communicate with each other.

Referring to FIG. 3, in the outdoor heat exchanger (23), a boundary (53) between adjacent ones of the main heat exchange parts (51*a*-51*c*) is positioned so as to laterally extend from each of upper two of the partition plates (39) in the second header collecting pipe (70). Moreover, in the outdoor heat exchanger (23), a boundary (54) between adjacent ones of the auxiliary heat exchange parts (52*a*-52*c*) is positioned so as to extend from each of lower two of the partition plates (39) of the first header collecting pipe (60) to an associated one of lower two of the partition plates (39) of the second header collecting pipe (70). Further, in the outdoor heat exchanger (23), a boundary (55) between the first main heat exchange part (51*a*) and the third auxiliary heat exchange part (52*c*), i.e., the boundary (55) between the heat exchange part (51*a*) of the upper heat exchange region (51) and the auxiliary heat exchange part (52*c*) of the lower heat exchange region (52), is positioned so as to extend from the uppermost partition plate (39) in the first header collecting pipe (60).

Referring to FIG. 2, in the outdoor heat exchanger (23), a liquid connection member (80) and a gas connection member (85) are provided. The liquid connection member (80) and the gas connection member (85) are attached to the first header collecting pipe (60).

The liquid connection member (80) includes a single distributor (81) and three thin pipes (82*a*-82*c*). The material of the distributor (81) and the thin pipes (82*a*-82*c*) forming the liquid connection member (80) is an aluminum alloy as in the header collecting pipes (60, 70) and the flat tube (33). A copper pipe (17) connecting between the outdoor heat exchanger (23) and the expansion valve (24) is connected to a lower end part of the distributor (81) through a joint which is not shown in the figure. The thin pipe (82*a*-82*c*) is, at one end thereof, connected to an upper end part of the distributor (81). In the distributor (81), the pipe connected to the lower end part of the distributor (81) and the thin pipes (82*a*-82*c*) communicate with each other. The thin pipe (82*a*-82*c*) is, at the other end thereof, connected to the lower space (62) of the first header collecting pipe (60), and communicates with an associated one of the communication spaces (62*a*-62*c*). The thin pipes (82*a*-82*c*) are joined to the first header collecting pipe (60) by brazing.

Referring to FIG. 3, the thin pipe (82*a*-82*c*) opens at part of an associated one of the communication spaces (62*a*-62*c*) close to a lower end thereof. That is, the first thin pipe (82*a*) opens at part of the first communication space (62*a*) close to the lower end thereof, the second thin pipe (82*b*) opens at part of the second communication space (62*b*) close to the lower end thereof, and the third thin pipe (82*c*) opens at part of the third communication space (62*c*) close to the lower end thereof. Note that the length of the thin pipe (82*a*-82*c*) is individually set such that a difference in flow rate of refrigerant flowing into the auxiliary heat exchange parts (52*a*-52*c*) is reduced as much as possible.

The gas connection member (85) is a single pipe having a relatively-large diameter. The material of the gas connection member (85) is an aluminum alloy as in the header collecting pipes (60, 70) and the flat tube (33). The gas connection member (85) is, at one end thereof, connected to a copper pipe (18) connecting between the outdoor heat exchanger (23) and the third port of the four-way valve (22) through a joint which is not shown in the figure. The gas connection member (85) opens, at the other end thereof, at part of the upper space (61) close to an upper end thereof in the first header collecting pipe (60). The gas connection member (85) is joined to the first header collecting pipe (60) by brazing.

<Flow of Refrigerant in Outdoor Heat Exchanger>

In the air-cooling operation of the air conditioner (10), the outdoor heat exchanger (23) functions as the condenser. A flow of refrigerant in the outdoor heat exchanger (23) during the air-cooling operation will be described.

Gas refrigerant discharged from the compressor (21) is supplied to the outdoor heat exchanger (23). The gas refrigerant sent from the compressor (21) flows into the upper space (61) of the first header collecting pipe (60) through the gas connection member (85), and then is distributed to the flat tubes (33) of the main heat exchange parts (51*a*-51*c*). While flowing through the fluid passages (34), the refrigerant flowing into each of the fluid passages (34) of the flat tubes (33) is condensed by dissipating heat to outdoor air, and then flows into each of the communication spaces (71*c*, 71*d*, 71*e*) of the second header collecting pipe (70).

In the second header collecting pipe (70), the refrigerant flowing into the third communication space (71*c*) is distributed to the flat tubes (33) of the third auxiliary heat exchange part (52*c*). The refrigerant flowing into the fourth communication space (71*d*) flows into the first communication space (71*a*) through the first communication pipe (72), and is distributed to the flat tubes (33) of the first auxiliary heat exchange part (52*a*). The refrigerant flowing into the fifth communication space (71*e*) flows into the second communication space (71*b*) through the second communication pipe (73), and is distributed to the flat tubes (33) of the second auxiliary heat exchange part (52*b*). While flowing through the fluid passages (34), the refrigerant flowing into each of the fluid passages (34) of the flat tubes (33) of the auxiliary heat exchange parts (52*a*-52*c*) enters a sub-cooled liquid state by dissipating heat to outdoor air, and then flows into the communication spaces (62*a*-62*c*) of the lower space (62) of the first header collecting pipe (60).

The refrigerant flowing into each of the communication spaces (62*a*-62*c*) of the lower space (62) of the first header collecting pipe (60) flows into the distributor (81) through an associated one of the thin pipes (82*a*-82*c*) of the liquid connection member (80). In the distributor (81), the flows of refrigerant from the thin pipes (82*a*-82*c*) are joined together. The refrigerant joined together at the distributor (81) flows out from the outdoor heat exchanger (23) toward the expansion valve (24). As in the foregoing, in the air-cooling operation, refrigerant flows, in the outdoor heat exchanger (23), into the main heat exchange parts (51*a*-51*c*) of the upper heat exchange region (51) and dissipates heat. Then, the refrigerant flows into the auxiliary heat exchange parts (52*a*-52*c*) of the lower heat exchange region (52), and further dissipates heat.

In the air-heating operation of the air conditioner (10), the outdoor heat exchanger (23) functions as the evaporator. A flow of refrigerant in the outdoor heat exchanger (23) during the air-heating operation will be described.

Refrigerant expanded into a gas-liquid two-phase refrigerant upon passage of the expansion valve (24) is supplied to the outdoor heat exchanger (23). The refrigerant sent from the expansion valve (24) flows into the distributor (81) of the liquid connection member (80), and then flows into the thin pipes (82*a*-82*c*). Subsequently, the refrigerant is distributed to the communication spaces (62*a*-62*c*) of the lower space (62) of the first header collecting pipe (60).

The refrigerant flowing into each of the communication spaces (62*a*-62*c*) of the lower space (62) of the first header collecting pipe (60) is distributed to the flat tubes (33) of an associated one of the auxiliary heat exchange parts (52*a*-52*c*). The refrigerant flowing into each of the fluid passages (34) of the flat tubes (33) flows into an associated one of the communication spaces (71*a*, 71*b*, 71*c*) of the second header collecting pipe (70) through the fluid passage (34). The refrigerant flowing into the communication spaces (71*a*, 71*b*, 71*c*) is still in the gas-liquid two-phase state.

In the second header collecting pipe (70), the refrigerant flowing into the first communication space (71*a*) flows into the fourth communication space (71*d*) through the first communication pipe (72), and is distributed to the flat tubes (33) of the second main heat exchange part (51*b*). The refrigerant flowing into the second communication space (71*b*) flows into the fifth communication space (71*e*) through the second communication pipe (73), and is distributed to the flat tubes (33) of the third main heat exchange part (51*c*). The refrigerant flowing into the third communication space (71*c*) is distributed to the flat tubes (33) of the first main heat exchange part (51*a*). While flowing through the fluid passages (34), the refrigerant flowing into each of the fluid passages (34) of the flat tubes (33) of the main heat exchange parts (51*a*-51*c*) is evaporated by absorbing heat from outdoor air, and enters a substantially gas single-phase state. Then, the flows of refrigerant are joined together at the upper space (61) of the first header collecting pipe (60). The refrigerant joined together at the upper space (61) of the first header collecting pipe (60) flows out from the gas connection member (85) toward the compressor (21). As in the foregoing, in the air-heating operation, refrigerant flows, in the outdoor heat exchanger (23), into the auxiliary heat exchange parts (52*a*-52*c*) of the lower heat exchange region (52). Then, the refrigerant flows into the main heat exchange parts (51*a*-51*c*) of the upper heat exchange region (51), and absorbs heat.

Advantages of First Embodiment

The outdoor heat exchanger (23) of the present embodiment includes the plural pairs of main heat exchange part (51*a*-51*c*) and auxiliary heat exchange part (52*a*-52*c*), through each of which refrigerant sequentially circulates. The outdoor heat exchanger (23) is divided into the upper heat exchange region (51) in which the main heat exchange parts (51*a*-51*c*) are arranged in the vertical direction and the lower heat exchange region (52) in which the auxiliary heat exchange parts (52*a*-52*c*) are arranged in the vertical direction. That is, in the outdoor heat exchanger (23) of the present embodiment, the main heat exchange parts (51*a*-51*c*) are arranged so as to be concentrated on one side (upper side) of the outdoor heat exchanger (23) in the vertical direction, and the auxiliary heat exchange parts (52*a*-52*c*) are arranged so as to be concentrated on the opposite side (lower side) of the outdoor heat exchanger (23) in the vertical direction. Thus, the number of parts where the main heat exchange part and the auxiliary heat exchange part are adjacent to each other can be reduced to the minimum of one part. That is, in the outdoor heat exchanger (23) of the present embodiment, the part where the main heat exchange part (51*a*-51*c*) and the auxiliary heat exchange part (52*a*-52*c*) are adjacent to each other is only part where the first main heat exchange part (51*a*) positioned lowermost in the upper heat exchange region (51) and the third auxiliary heat exchange part (52*c*) positioned uppermost in the lower heat exchange region (52) are adjacent to each other.

The temperature of refrigerant circulating through the main heat exchange part (51*a*-51*c*) and the temperature of refrigerant circulating through the auxiliary heat exchange part (52*a*-52*c*) are different from each other. Specifically, the temperature of refrigerant circulating through the main heat exchange part (51*a*-51*c*) is higher than the temperature of refrigerant circulating through the auxiliary heat exchange part (52*a*-52*c*). Thus, heat exchange between refrigerant occurs between the adjacent pipes (33) of the main heat exchange part and the auxiliary heat exchange part through the fin (36) provided therebetween, and therefore the amount of heat to be exchanged between refrigerant and air decreases accordingly. Thus, a so-called "heat loss" is caused. Consequently, a heat exchange efficiency of the outdoor heat exchanger (23) is lowered. Such a heat loss of refrigerant increases with increasing the number of parts where the main heat exchange part and the auxiliary heat exchange part are adjacent to each other. Thus, the lesser the number of parts where the main heat exchange part and the auxiliary heat exchange part are adjacent to each other, the more the lowering of the heat exchange efficiency can be reduced. Suppose that, in a heat exchanger in which a plurality of main heat exchange parts and a plurality of auxiliary heat exchange parts are provided and the number of main heat exchange parts is the same as the number of auxiliary heat exchange parts, plural pairs of main heat exchange part and auxiliary heat exchange part which are adjacent to each other are stacked on each other in the vertical direction. In such a case, the number of parts where the main heat exchange part and the auxiliary heat exchange part are adjacent to each other is less than the total number of main heat exchange parts and auxiliary heat exchange parts by one. On the other hand, in the outdoor heat exchanger (23) of the present embodiment, the number of parts where the main heat exchange part (51*a*-51*c*) and the auxiliary heat exchange part (52*a*-52*c*) are adjacent to each other is the minimum of one part. Thus, the heat loss of refrigerant can be reduced as much as possible, and the lowering of the heat exchange efficiency can be significantly reduced.

Typically, in an air heat exchanger such as the heat exchangers (23, 25) of the present embodiment, an air velocity increases toward the center of the air heat exchanger. In the foregoing heat exchanger in which the plural pairs of main heat exchange part and auxiliary heat exchange part which are adjacent to each other are stacked on each other in the vertical direction, the auxiliary heat exchange part is also arranged within a region where the air velocity is high, and the area of the main heat exchange part arranged in the region where the air velocity is high is reduced accordingly. Since the main heat exchange part requires a greater amount of heat contained in air than that required for the auxiliary heat exchange part, a sufficient performance of the main heat exchange part cannot be realized. On the other hand, in the outdoor heat exchanger (23) of the present embodiment, since the main heat exchange parts (51*a*-51*c*) are, as described above, concentrated on one side of the outdoor heat exchanger (23) and the auxiliary heat exchange parts (52*a*-52*c*) are concentrated on the other side of the outdoor heat exchanger (23), the auxiliary heat exchange parts (52*a*-52*c*) can be arranged in a region where an air velocity is low, and the main heat exchange parts (51*a*-51*c*) can be arranged in a region where the air velocity is high. Thus, a sufficient heat exchange performance of the main heat exchange parts (51*a*-51*c*) can be realized.

In the outdoor heat exchanger (23) of the present embodiment, the liquid connection member (80) and the gas connection member (85) are both attached to the first header collecting pipe (60). That is, in the outdoor heat exchanger (23) of the present embodiment, the members configured to allow a flow of refrigerant into/from the heat exchange parts (51*a*-51*c*, 52*a*-52*c*) are attached to the first header collecting pipe (60). Thus, according to the present embodiment, the connection position of the pipe (17) extending from the expansion valve (24) with the outdoor heat exchanger (23) and the connection position of the pipe (18) extending from the four-way valve (22) with the outdoor heat exchanger (23) can be close to each other, and therefore an installation operation of the outdoor heat exchanger (23) can be facilitated.

In the first header collecting pipe (60) of the outdoor heat exchanger (23) of the present embodiment, the thin pipe (82*a*-82*c*) of the liquid connection member (80) communicates with an associated one of the communication spaces (62*a*-62*c*) at the lower end thereof in the lower space (62). Thus, if the outdoor heat exchanger (23) of the present embodiment functions as the condenser, it can be ensured that high-density liquid refrigerant is sent from the communication space (62*a*-62*c*) to the thin pipe (82*a*-82*c*) of the liquid connection member (80). Moreover, in the first header collecting pipe (60) of the outdoor heat exchanger (23) of the present embodiment, the gas connection member (85) communicates with the upper space (61) at the upper end thereof. Thus, if the outdoor heat exchanger (23) of the present embodiment functions as the evaporator, it can be ensured that low-density gas refrigerant is sent from the upper space (61) to the gas connection member (85).

First Variation of First Embodiment

Figure 5:
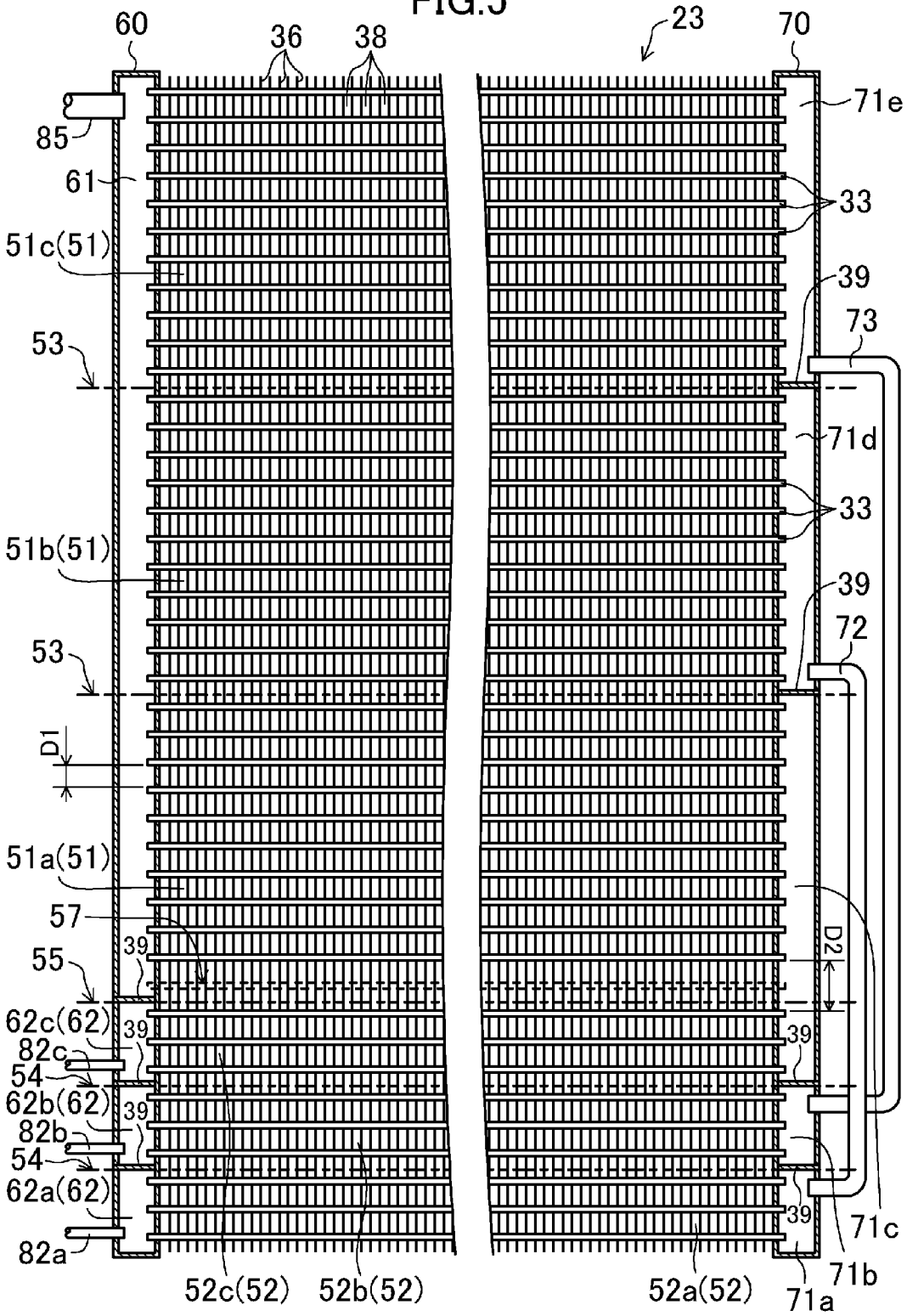
FIG. 5 is a partial cross-sectional view illustrating a front side of an outdoor heat exchanger of a first variation of the first embodiment.

In the outdoor heat exchanger (23) of the first embodiment, no flat tube (33) may be provided at a position indicated by a dashed line in FIG. 5. Specifically, in an outdoor heat exchanger (23) of a first variation illustrated in FIG. 5, a flat tube (33) positioned lowermost in a first main heat exchange part (51*a*) is omitted from the first main heat exchange part (51*a*) and a third auxiliary heat exchange part (52*c*) which are adjacent to each other. That is, the flat tube (33) closest to a flat tube (33) of the third auxiliary heat exchange part (52*c*) is omitted from the first main heat exchange part (51*a*).

In the outdoor heat exchanger (23) of the present variation, part of the outdoor heat exchanger (23) between the flat tubes (33) which are adjacent to each other across a boundary (55) between the first main heat exchange part (51*a*) and the third auxiliary heat exchange part (52*c*), i.e., part of the outdoor heat exchanger (23) where no flat tube (33) is provided, forms a heat transfer reduction structure (57).

According to the foregoing configuration, the distance D2 between the flat tube (33) positioned lowermost in the first main heat exchange part (51*a*) and the flat tube (33) positioned uppermost in the third auxiliary heat exchange part (52*c*) is longer than the distance D1 between adjacent ones of the other flat tubes (33). Thus, heat transfer between the flat tubes (33) of the first main heat exchange part (51*a*) and the third auxiliary heat exchange part (52*c*) which are adjacent to each other can be reduced. That is, the amount of heat exchange between refrigerant of the adjacent flat tubes (33) (i.e., a heat loss) can be further reduced. As a result, lowering of a heat exchange efficiency of the outdoor heat exchanger (23) can be further reduced.

In the present variation, the flat tube (33) positioned uppermost in the third auxiliary heat exchange part (52*c*) may be omitted instead of the flat tube (33) positioned lowermost in the first main heat exchange part (51*a*), or both of the flat tube (33) positioned lowermost in the first main heat exchange part (51*a*) and the flat tube (33) positioned uppermost in the third auxiliary heat exchange part (52*c*) may be omitted.

Second Variation of First Embodiment

Figure 6:
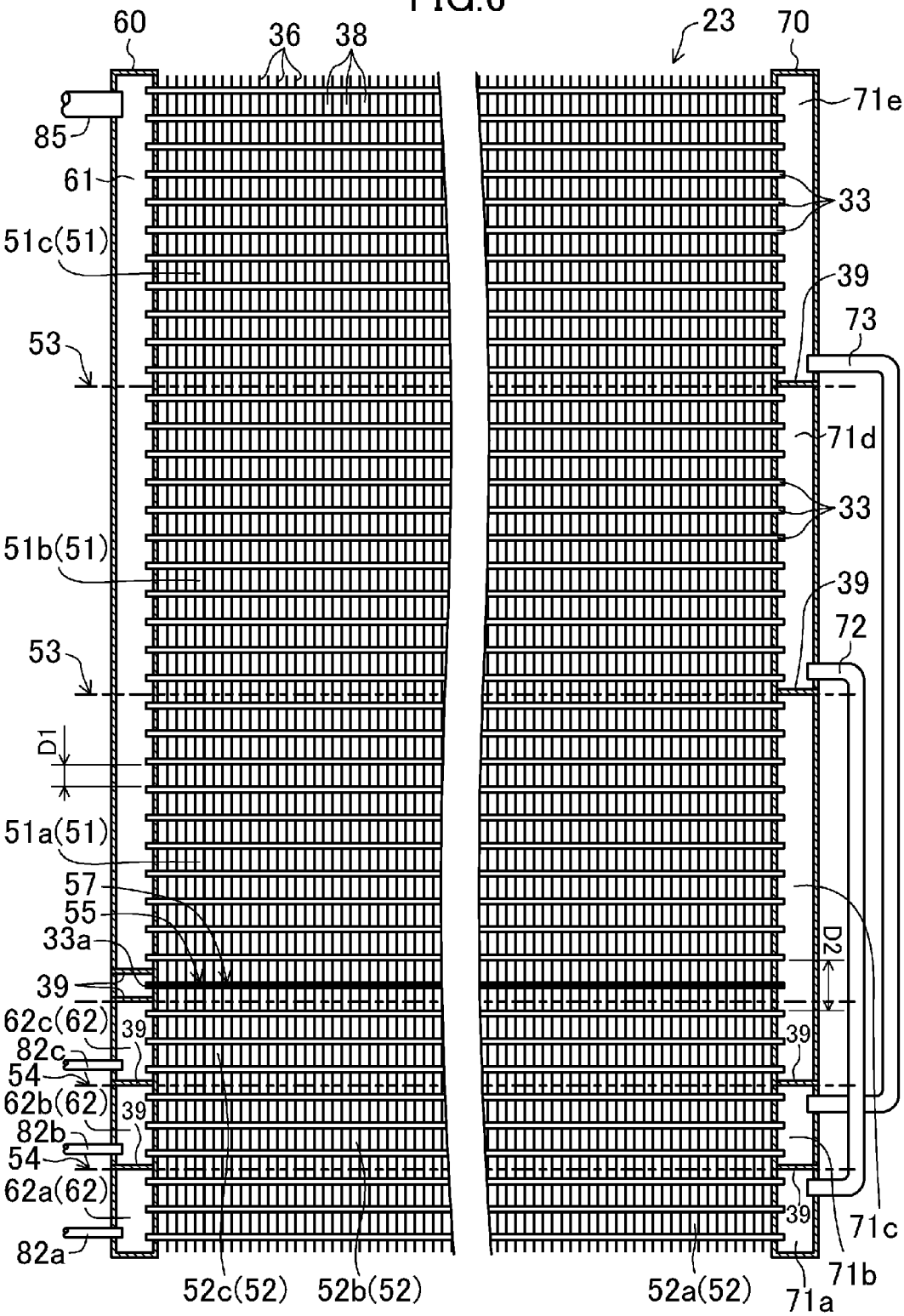
FIG. 6 is a partial cross-sectional view illustrating a font side of an outdoor heat exchanger of a second variation of the first embodiment.

In the outdoor heat exchanger (23) of the first embodiment, refrigerant may not substantially circulate through a flat tube (33*a*) indicated by a black part in FIG. 6. Specifically, in a first header collecting pipe (60) of an outdoor heat exchanger (23) of a second variation, partition plates (39) are arranged respectively on upper and lower sides of the flat tube (33*a*) positioned lowermost in a first main heat exchange part (51*a*). Thus, in the outdoor heat exchanger (23) of the present variation, the flat tube (33*a*) is in such a substantially-closed state that refrigerant does not pass through the flat tube (33*a*).

That is, in the outdoor heat exchanger (23) of the present variation, a boundary (55) between the first main heat exchange part (51*a*) of an upper heat exchange region (51) and a third auxiliary heat exchange part (52*c*) of a lower heat exchange region (52) is positioned between the partition plates (39) provided on the upper and lower sides of the flat tube (33*a*). The substantially-closed flat tube (33*a*) is positioned at the boundary (55). In the outdoor heat exchanger (23) of the present variation, the substantially-closed flat tube (33*a*) forms a heat transfer reduction structure (57).

Of flat tubes (33) through each of which refrigerant substantially circulates, the distance D2 between the flat tube (33) positioned lowermost in the first main heat exchange part (51*a*) and the flat tube (33) positioned uppermost in the third auxiliary heat exchange part (52*c*) is, according to the foregoing configuration, longer than the distance D1 between adjacent ones of the other flat tubes (33). This reduces heat transfer between the flat tubes (33) of the first main heat exchange part (51*a*) and the third auxiliary heat exchange part (52*c*) which are adjacent to each other. That is, the amount of heat exchange between refrigerant of the adjacent flat tubes (33) (i.e., a heat loss) can be further reduced. As a result, lowering of a heat exchange efficiency of the outdoor heat exchanger (23) can be further reduced.

In the first header collecting pipe (60) of the present variation, the partition plates (39) may be provided right above and below the flat tube (33) positioned uppermost in the third auxiliary heat exchange part (52*c*), instead of the flat tube (33*a*) positioned lowermost in the first main heat exchange part (51*a*). Alternatively, the partition plates (39) may be provided right above the flat tube (33*a*) positioned lowermost in the first main heat exchange part (Ma) and right below the flat tube (33) positioned uppermost in the third auxiliary heat exchange part (52*c*).

Second Embodiment of the Invention

A second embodiment of the present disclosure will be described. In the present embodiment, the configuration of the outdoor heat exchanger (23) of the first embodiment is changed. Differences in outdoor heat exchanger (23) between the present embodiment and the first embodiment will be described with reference to FIGS. 7 and 8.

Figure 7:
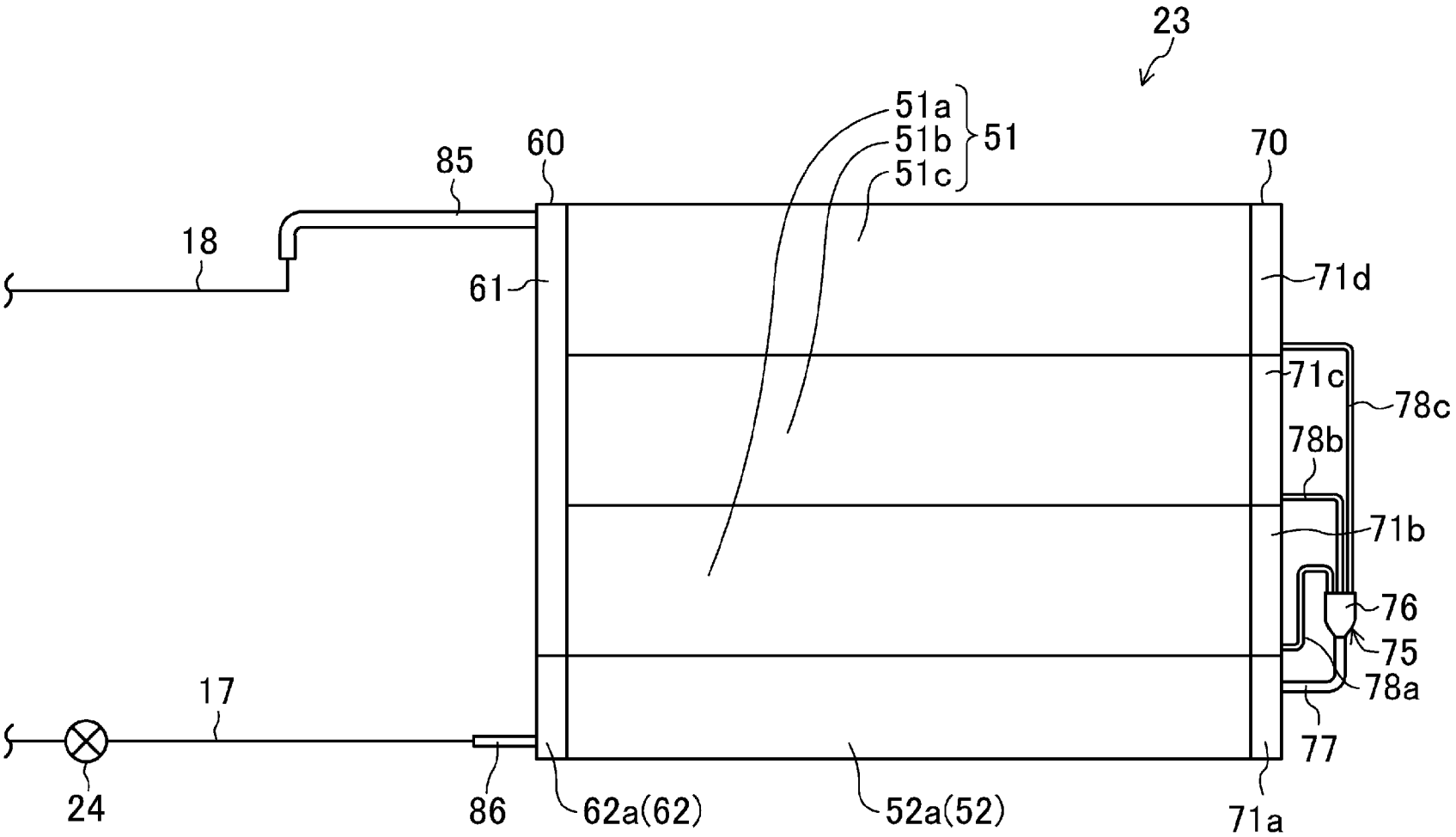
FIG. 7 is a front view illustrating a schematic configuration of an outdoor heat exchanger of a second embodiment.

Referring to FIG. 7, flat tubes (33) of the outdoor heat exchanger (23) are, as in the first embodiment, laterally divided for an upper heat exchange region (51) and a lower heat exchange region (52). The upper heat exchange region (51) is divided into three main heat exchange parts (51*a*-

Figure 8:
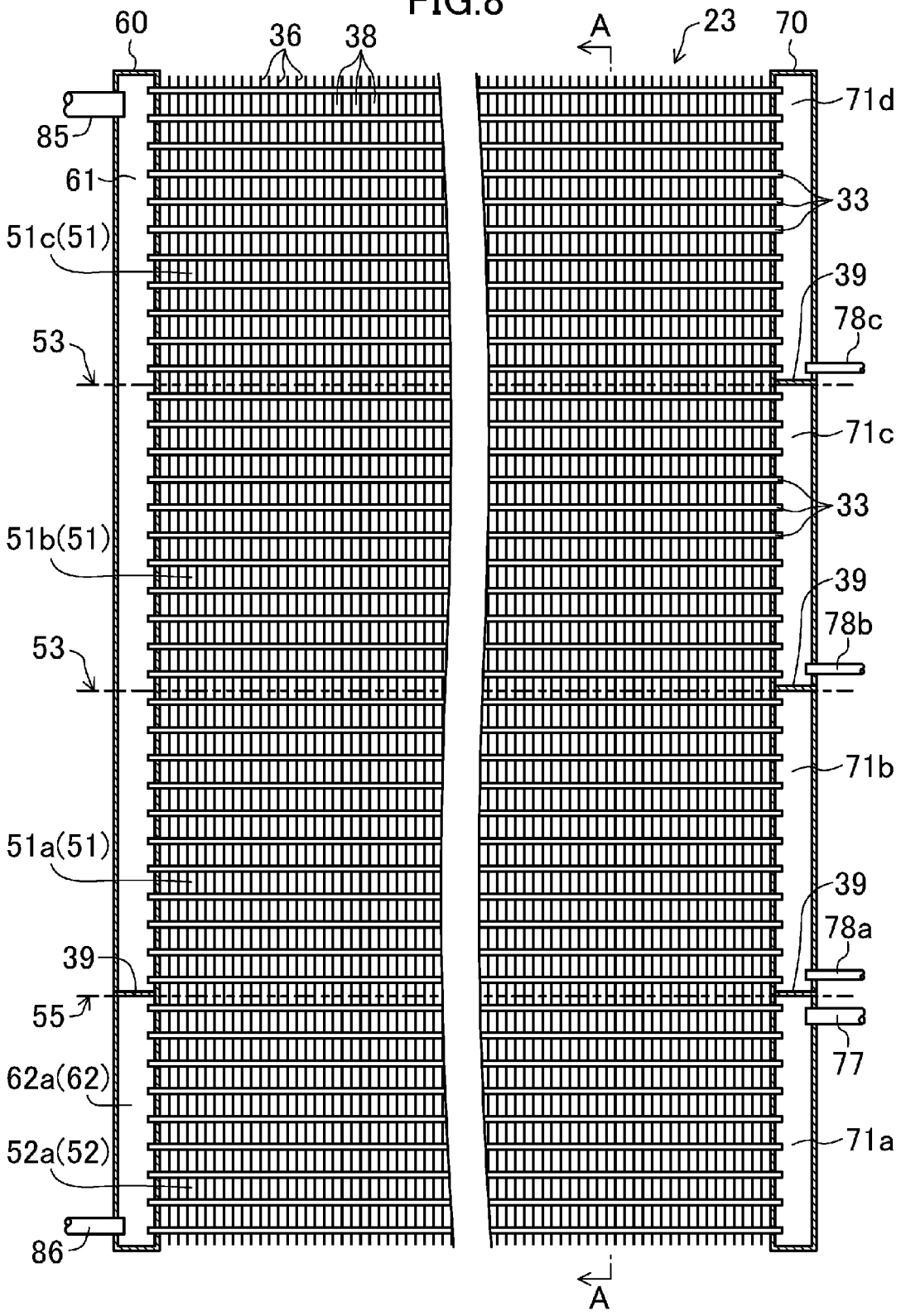
FIG. 8 is a partial cross-sectional view illustrating a front side of the outdoor heat exchanger of the second embodiment.

51*c*) arranged in the vertical direction, and the lower heat exchange region (52) forms a single auxiliary heat exchange part (52*a*). That is, in the upper heat exchange region (51), the first main heat exchange part (51*a*), the second main heat exchange part (51*b*), and the third main heat exchange part (51*c*) are formed in this order from the bottom to the top. Referring to FIG. 8, the main heat exchange part (51*a*-51*c*) includes eleven flat tubes (33), and the auxiliary heat exchange part (52*a*) includes nine flat tubes (33). Note that the number of main heat exchange parts (51*a*-51*c*) formed in the upper heat exchange region (51) may be two or may be equal to or greater than four.

Each of internal spaces of a first header collecting pipe (60) and a second header collecting pipe (70) is laterally divided by partition plates (39).

Specifically, the internal space of the first header collecting pipe (60) is divided into an upper space (61) which is for gas refrigerant and corresponds to the upper heat exchange region (51), and a lower space (62) (communication space (62*a*)) which is for liquid refrigerant and corresponds to the lower heat exchange region (52). Note that the "liquid refrigerant" described herein means, as in the first embodiment, refrigerant in a liquid single-phase state or refrigerant in a gas-liquid two-phase state. The upper space (61) is a single space corresponding to all of the main heat exchange parts (51*a*-51*c*). That is, the upper space (61) communicates with all of the flat tubes (33) of the main heat exchange parts (51*a*-51*c*). The lower space (62) (communication space (62*a*)) is a single space corresponding to the auxiliary heat exchange part (52*a*), and communicates with the flat tubes (33) of the auxiliary heat exchange part (52*a*).

The internal space of the second header collecting pipe (70) is laterally divided into four communication spaces (71*a*-71*d*). Specifically, the internal space of the second header collecting pipe (70) is divided into three communication spaces (71*b*, 71*c*, 71*d*) corresponding respectively to the main heat exchange parts (51*a*-51*c*) of the upper heat exchange region (51), and a single communication spaces (71*a*) corresponding to the auxiliary heat exchange part (52*a*) of the lower heat exchange region (52). That is, in the internal space of the second header collecting pipe (70), the first communication space (71*a*) communicating with the flat tubes (33) of the auxiliary heat exchange part (52*a*), the second communication space (71*b*) communicating with the flat tubes (33) of the first main heat exchange part (51*a*), the third communication space (71*c*) communicating with the flat tubes (33) of the second main heat exchange part (51*b*), and the fourth communication space (71*d*) communicating with the flat tubes (33) of the third main heat exchange part (51*c*) are formed.

In the second header collecting pipe (70), a communication member (75) is provided. The communication member (75) includes a single distributor (76), a single main pipe (77), and three thin pipes (78*a*-78*c*). The main pipe (77) is, at one end thereof, connected to a lower end part of the distributor (76), and is, at the other end thereof, connected to the first communication space (71*a*) of the second header collecting pipe (70). The thin pipe (78*a*-78*c*) is, at one end thereof, connected to an upper end part of the distributor (76). In the distributor (81), the main pipe (77) and the thin pipes (78*a*-78*c*) communicate with each other. The thin pipe (78*ca*-78*c*) communicates, at the other end thereof, with an associated one of the second to fourth communication spaces (71*b*-71*d*) corresponding to the second header collecting pipe (70).

Referring to FIG. 8, the thin pipe (78*a*-78*c*) opens at part of an associated one of the second to fourth communication spaces (71*b*-71*d*) close to a lower end thereof. That is, the first thin pipe (78*a*) opens at part of the second communication space (71*b*) close to the lower end thereof, the second thin pipe (78*b*) opens at part of the third communication space (71*c*) close to the lower end thereof, and the third thin pipe (78*c*) opens at part of the fourth communication space (71*d*) close to the lower end thereof. Note that the length of the thin pipe (78*a*-78*c*) is individually set such that a difference in flow rate of refrigerant flowing into the main heat exchange parts (51*a*-51*c*) is reduced as much as possible. As described above, the communication member (75) of the second header collecting pipe (70) is connected so as to branch into the second to fourth communication spaces (71*b*-71*d*) corresponding respectively to the main heat exchange parts (51*a*-51*c*) from the first communication space (71*a*). That is, in the second header collecting pipe (70), the communication space (71*a*) corresponding to the lower heat exchange region (52) and the communication spaces (71*b*, 71*c*, 71*d*) corresponding to the upper heat exchange region (51) communicate with each other.

Referring to FIG. 8, in the outdoor heat exchanger (23), a boundary (53) between adjacent ones of the main heat exchange parts (51*a*-51*c*) is positioned so as to extend from each of upper two of the partition plates (39) in the second header collecting pipe (70). Moreover, in the outdoor heat exchanger (23), a boundary (55) between the first main heat exchange part (51*a*) and the third auxiliary heat exchange part (52*c*), i.e., the boundary (55) between the heat exchange part (51*a*) of the upper heat exchange region (51) and the auxiliary heat exchange part (52*c*) of the lower heat exchange region (52), is positioned between the partition plate (39) of the first header collecting pipe (60) and the lowermost partition plate (39) of the second header collecting pipe (70).

Referring to FIG. 7, in the outdoor heat exchanger (23), a liquid connection member (86) and a gas connection member (85) are provided. The liquid connection member (86) and the gas connection member (85) are attached to the first header collecting pipe (60). The liquid connection member (86) is a single pipe having a relatively-large diameter. The liquid connection member (86) is, at one end thereof, connected to a pipe connecting between the outdoor heat exchanger (23) and an expansion valve (24). The liquid connection member (86) opens, at the other end thereof, at part of the lower space (62) (communication space (62*a*)) close to a lower end thereof in the first header collecting pipe (60). The gas connection member (85) is a single pipe having a relatively-large diameter. The gas connection member (85) is, at one end thereof, connected to a pipe connecting between the outdoor heat exchanger (23) and a third port of a four-way valve (22). The gas connection member (85) opens, at the other end thereof, at part of the upper space (61) close to an upper end thereof in the first header collecting pipe (60).

In an air-cooling operation of an air conditioner (10), the outdoor heat exchanger (23) functions as a condenser. A flow of refrigerant in the outdoor heat exchanger (23) during the air-cooling operation will be described.

Gas refrigerant sent from the compressor (21) flows into the upper space (61) of the first header collecting pipe (60) through the gas connection member (85), and then is distributed to the flat tubes (33) of the main heat exchange parts (51*a*-51*c*). While flowing through fluid passages (34), the refrigerant flowing into each of the fluid passages (34) of the flat tubes (33) is condensed by dissipating heat to outdoor air, and then flows into the second to fourth communication spaces (71*b*-71*d*) corresponding to the second header collecting pipe (70). The refrigerant flowing into each of the communication spaces (71*b*-71*d*) passes through an associated one of the thin pipes (78*ca*-78*c*) of the communication member (75), and such flows of refrigerant are joined together at the distributor (76). The refrigerant joined together at the distributor (76) flows into the first communication space (71*a*) through the main pipe (77), and then is distributed to the flat tubes (33) of the auxiliary heat exchange part (52*a*). While flowing through the fluid passages (34), the refrigerant flowing into each of the fluid passages (34) of the flat tubes (33) of the auxiliary heat exchange part (52*a*) enters a sub-cooled liquid state by dissipating heat to outdoor air, and then flows into the lower space (62) (communication space (62*a*)) of the first header collecting pipe (60). The refrigerant flowing into the lower space (62) of the first header collecting pipe (60) flows out from the liquid connection member (86) toward the expansion valve (24). As in the foregoing, in the air-cooling operation, refrigerant flows, in the outdoor heat exchanger (23), into the main heat exchange parts (51*a*-51*c*) of the upper heat exchange region (51), and dissipates heat. Then, the refrigerant flows into the auxiliary heat exchange part (52*a*) of the lower heat exchange region (52), and further dissipates heat.

In an air-heating operation of the air conditioner (10), the outdoor heat exchanger (23) functions as an evaporator. A flow of refrigerant in the outdoor heat exchanger (23) during the air-heating operation will be described.

Refrigerant sent from the expansion valve (24) flows into the lower space (62) of the first header collecting pipe (60) through the liquid connection member (86), and then is distributed to the flat tubes (33) of the auxiliary heat exchange part (52*a*). The refrigerant flowing into each of the fluid passages (34) of the flat tubes (33) flows into the first communication space (71*a*) of the second header collecting pipe (70) through the fluid passage (34). The refrigerant flowing into the first communication space (71*a*) is still in a gas-liquid two-phase state. In the second header collecting pipe (70), the refrigerant flowing into the first communication space (71*a*) flows into the distributor (76) of the communication member (75), and then flows into the thin pipes (78*a*-78*c*). Subsequently, the refrigerant is distributed to the second to fourth communication spaces (71*b*-71*d*). The refrigerant flowing into each of the second to fourth communication spaces (71*b*-71*d*) is distributed to the flat tubes (33) of an associated one of the main heat exchange parts (51*a*-51*c*). While flowing through the fluid passages (34), the refrigerant flowing into each of the fluid passages (34) of the flat tubes (33) of the main heat exchange parts (51*a*-51*c*) is evaporated by absorbing heat from outdoor air, and enters a substantially gas single-phase state. Then, the flows of refrigerant are joined together at the upper space (61) of the first header collecting pipe (60). The refrigerant joined together at the upper space (61) of the first header collecting pipe (60) flows out from the gas connection member (85) toward the compressor (21). As in the foregoing, in the air-heating operation, refrigerant flows, in the outdoor heat exchanger (23), into the auxiliary heat exchange part (52*a*) of the lower heat exchange region (52). Then, the refrigerant flows into the main heat exchange parts (51*a*-51*c*) of the upper heat exchange region (51), and absorbs heat.

In the outdoor heat exchanger (23) of the present embodiment, the main heat exchange parts (51*a*-51*c*) are arranged so as to be concentrated on one side (upper side) of the outdoor heat exchanger (23) in the vertical direction, and the auxiliary heat exchange part (52*a*) is arranged on the opposite side (lower side) of the outdoor heat exchanger (23) in the vertical direction. Thus, as in the first embodiment, the number of parts where the main heat exchange part and the auxiliary heat exchange part are adjacent to each other can be reduced to the minimum of one part. That is, in the outdoor heat exchanger (23) of the present embodiment, the part where the main heat exchange part (51*a*-51*c*) and the auxiliary heat exchange part (52*a*) are adjacent to each other is only part where the first main heat exchange part (51*a*) positioned lowermost in the upper heat exchange region (51) and the auxiliary heat exchange part (52*a*) are adjacent to each other. Thus, in the present embodiment, a heat loss of refrigerant can be reduced as much as possible, and lowering of a heat exchange efficiency can be significantly reduced.

In the outdoor heat exchanger (23) of the present embodiment, the liquid connection member (86) and the gas connection member (85) are both attached to the first header collecting pipe (60). Thus, as in the first embodiment, the connection position of a pipe extending from the expansion valve (24) with the outdoor heat exchanger (23) and the connection position of a pipe extending from the four-way valve (22) with the outdoor heat exchanger (23) can be close to each other, and therefore an installation operation of the outdoor heat exchanger (23) can be facilitated.

In the first header collecting pipe (60) of the outdoor heat exchanger (23) of the present embodiment, the liquid connection member (86) communicates with the lower space (62) at the position close to the lower end of the lower space (62). Thus, as in the first embodiment, if the outdoor heat exchanger (23) functions as the condenser, it can be ensured that high-density liquid refrigerant is sent from the lower space (62) to the liquid connection member (86). Moreover, in the first header collecting pipe (60) of the outdoor heat exchanger (23) of the present embodiment, the gas connection member (85) communicates with the upper space (61) at the position close to the upper end of the upper space (61). Thus, as in the first embodiment, if the outdoor heat exchanger (23) functions as the evaporator, it can be ensured that low-density gas refrigerant is sent from the upper space (61) to the gas connection member (85). In the second header collecting pipe (70) of the present embodiment, the thin pipe (78*a*-78*c*) of the communication member (75) communicates with an associated one of the second to fourth communication spaces (71*b*-71*d*) at the position close to the lower end of the associated one of the second to fourth communication spaces (71*b*-71*d*). Thus, if the outdoor heat exchanger (23) functions as the condenser, it can be ensured that high-density liquid refrigerant is sent from each of the second to fourth communication spaces (71*b*-71*d*) to an associated one of the thin pipes (78*a*-78*c*).

In the outdoor heat exchanger (23) of the present embodiment, if the outdoor heat exchanger (23) functions as the evaporator (i.e., in the case of the air-heating operation), a relatively-large pressure loss is caused when refrigerant from the first communication space (71*a*) passes through the thin pipes (78*a*-78*c*). Due to such a pressure loss, the temperature of refrigerant increases. Specifically, the length and diameter of the thin pipe (78*a*-78*c*) are adjusted such that the temperature of refrigerant passing through the thin pipe (78*a*-78*c*) can be equal to or greater than 0° C. This reduces frost formed when the temperature of outdoor air which exchanged heat with refrigerant falls below 0° C. That is, frosting in the outdoor heat exchanger (23) can be reduced.

Variation of Second Embodiment

The outdoor heat exchanger (23) of the second embodiment may be changed as in the variations of the first embodiment.

Figure 9:
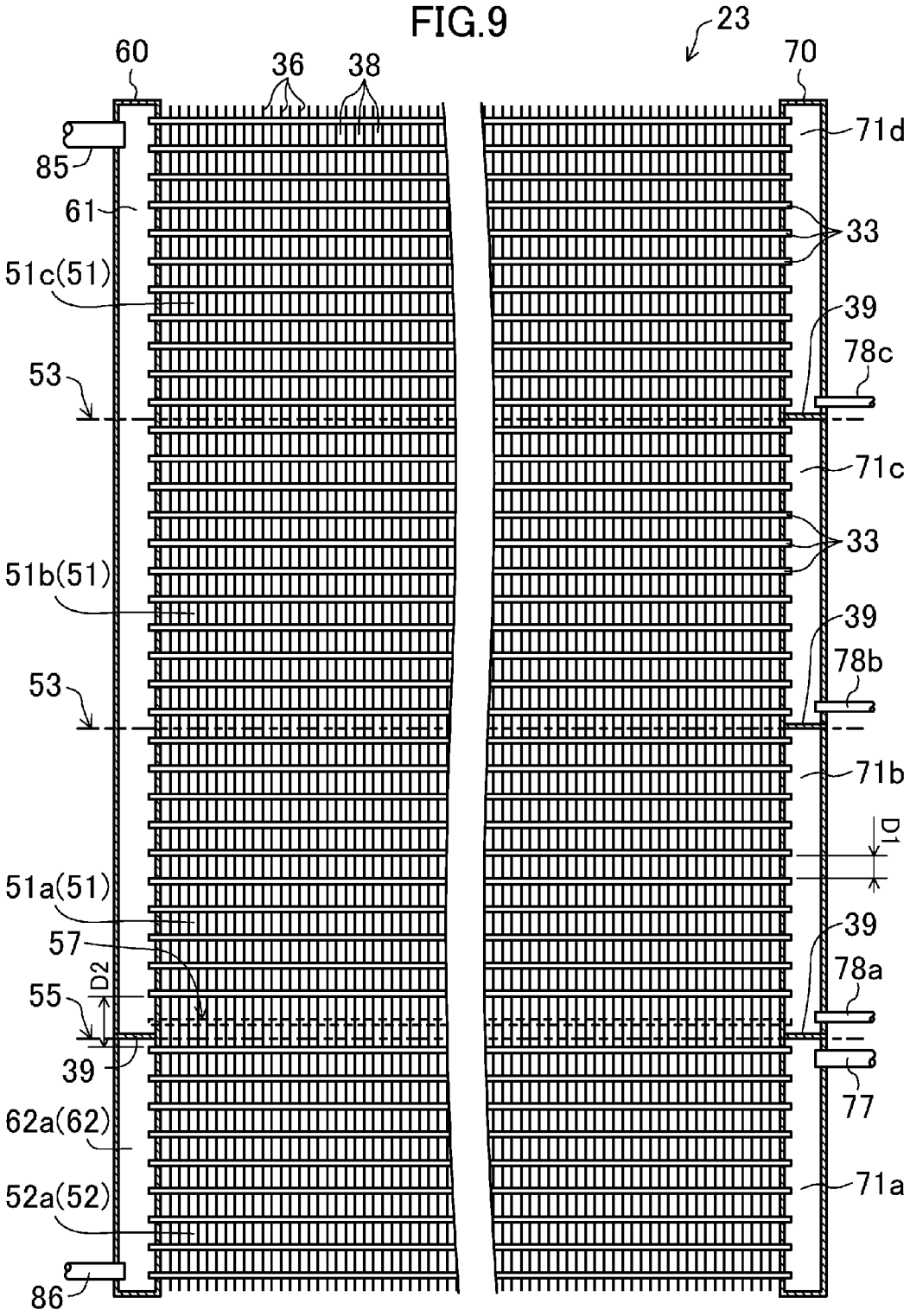
FIG. 9 is a partial cross-sectional view illustrating a front side of an outdoor heat exchanger of a variation of the second embodiment.

Specifically, in an outdoor heat exchanger (23) of the present variation, no flat tube (33) may be provided at a position indicated by a dashed line in FIG. 9. That is, a flat tube (33) positioned lowermost in a first main heat exchange part (51*a*) is omitted from the first main heat exchange part (51*a*) and an auxiliary heat exchange part (52*a*) which are adjacent to each other. In the outdoor heat exchanger (23) of the present variation, part of the outdoor heat exchanger (23) between flat tubes (33) which are adjacent to each other across a boundary (55) between the first main heat exchange part (51*a*) and the auxiliary heat exchange part (52*a*), i.e., part of the outdoor heat exchanger (23) where no flat tube (33) is provided, forms a heat transfer reduction structure (57). Thus, the distance D2 between the flat tube (33) positioned lowermost in the first main heat exchange part (51*a*) and the flat tube (33) positioned uppermost in the auxiliary heat exchange part (52*a*) is longer than the distance D1 between adjacent ones of the other flat tubes (33). This reduces heat transfer between the flat tubes (33) of the first main heat exchange part (51*a*) and the auxiliary heat exchange part (52*a*) which are adjacent to each other. That is, the amount of heat exchange between refrigerant of the adjacent flat tubes (33) (i.e., a heat loss) can be further reduced. As a result, lowering of a heat exchange efficiency of the outdoor heat exchanger (23) can be further reduced.

Figure 10:
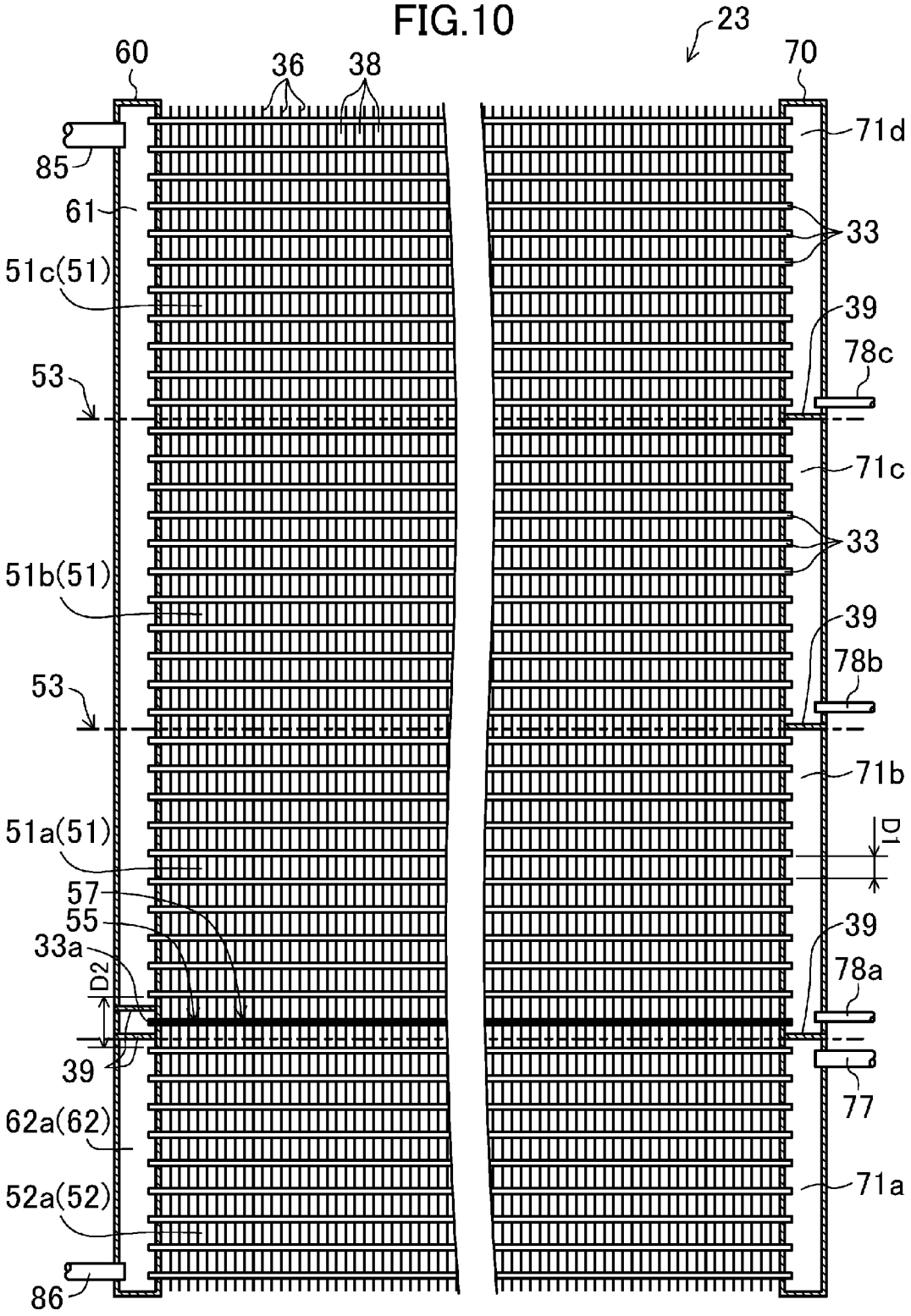
FIG. 10 is a partial cross-sectional view illustrating a front side of an outdoor heat exchanger of another variation of the second embodiment.

In the outdoor heat exchanger (23) of the present variation, refrigerant may not substantially circulate through a flat tube (33*a*) indicated by a black part in FIG. 10. That is, in a first header collecting pipe (60) of the outdoor heat exchanger (23) of the present variation, partition plates (39) are arranged respectively on upper and lower sides of the flat tube (33*a*) positioned lowermost in the first main heat exchange part (51*a*). Thus, the flat tube (33*a*) is in such a substantially-closed state that refrigerant does not pass through the flat tube (33*a*). That is, in the outdoor heat exchanger (23) of the present variation, a boundary (55) between the first main heat exchange part (51*a*) of an upper heat exchange region (51) and the auxiliary heat exchange part (52*a*) of a lower heat exchange region (52) is positioned between the partition plates (39) provided respectively on the upper and lower sides of the flat tube (33*a*). The substantially-closed flat tube (33*a*) is positioned at the boundary (55). In the outdoor heat exchanger (23) of the present variation, the substantially-closed flat tube (33*a*) forms a heat transfer reduction structure (57). Of the flat tubes (33) through each of which refrigerant substantially flows, the distance D2 between the flat tube (33) positioned lowermost in the first main heat exchange part (51*a*) and the flat tube (33) positioned uppermost in the auxiliary heat exchange part (52*a*) is longer than the distance D1 between adjacent ones of the other flat tubes (33). This reduces heat transfer between the flat tubes (33) of the first main heat exchange part (51*a*) and the auxiliary heat exchange part (52*a*) which are adjacent to each other. That is, the amount of heat exchange between refrigerant of the adjacent flat tubes (33) (i.e., a heat loss) can be further reduced. As a result, lowering of a heat exchange efficiency of the outdoor heat exchanger (23) can be further reduced.

Third Embodiment of the Invention

Figure 11:
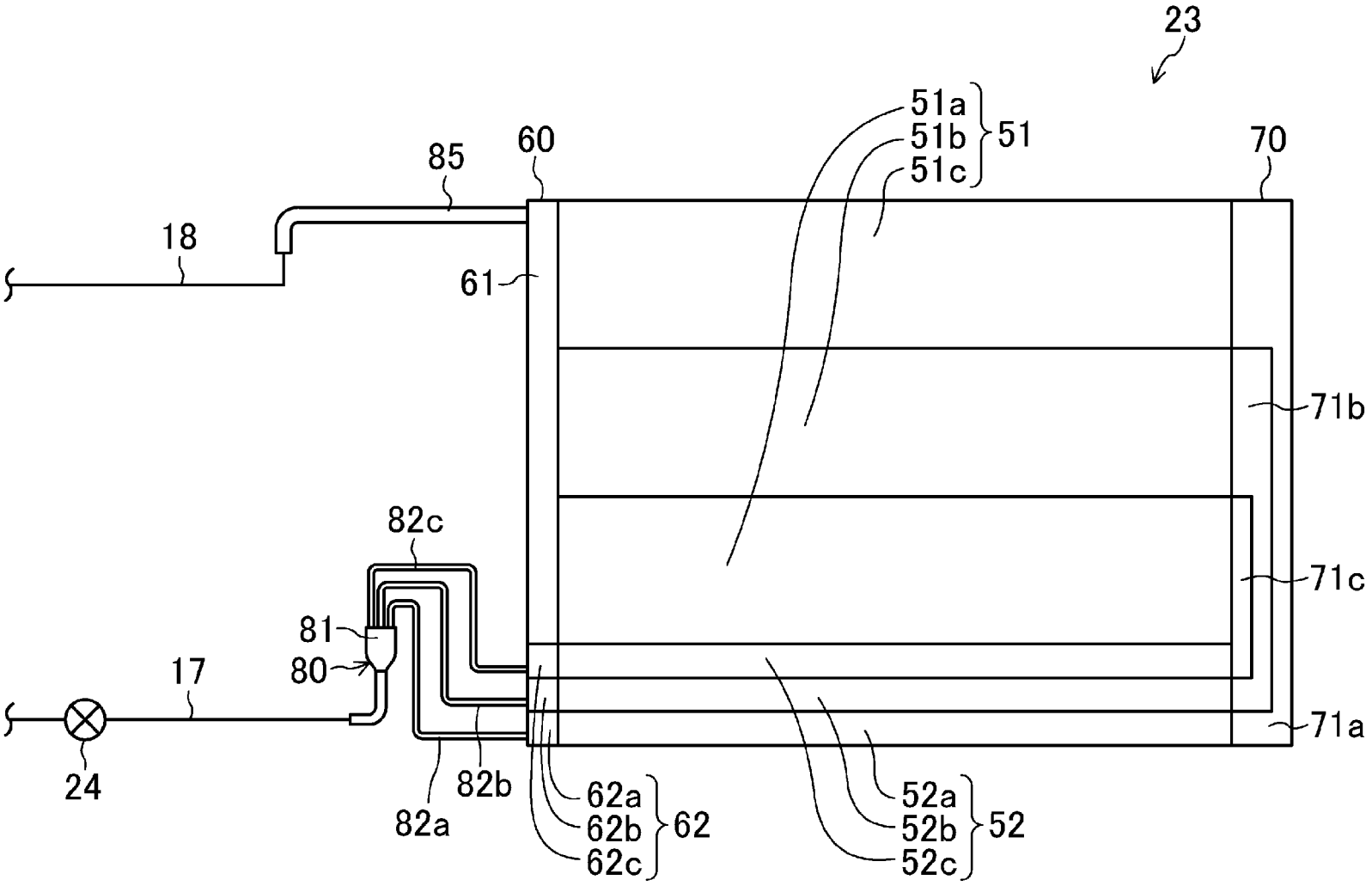
FIG. 11 is a front view illustrating a schematic configuration of an outdoor heat exchanger of a third embodiment.

A third embodiment of the present disclosure will be described. In the present embodiment, the configuration of the second header collecting pipe (70) of the outdoor heat exchanger (23) of the first embodiment is changed. The other configuration is similar to that of the first embodiment. In the present embodiment, only a configuration of a second header collecting pipe (70) of an outdoor heat exchanger (23) will be described with reference to FIGS. 11 and 12.

Figure 12:
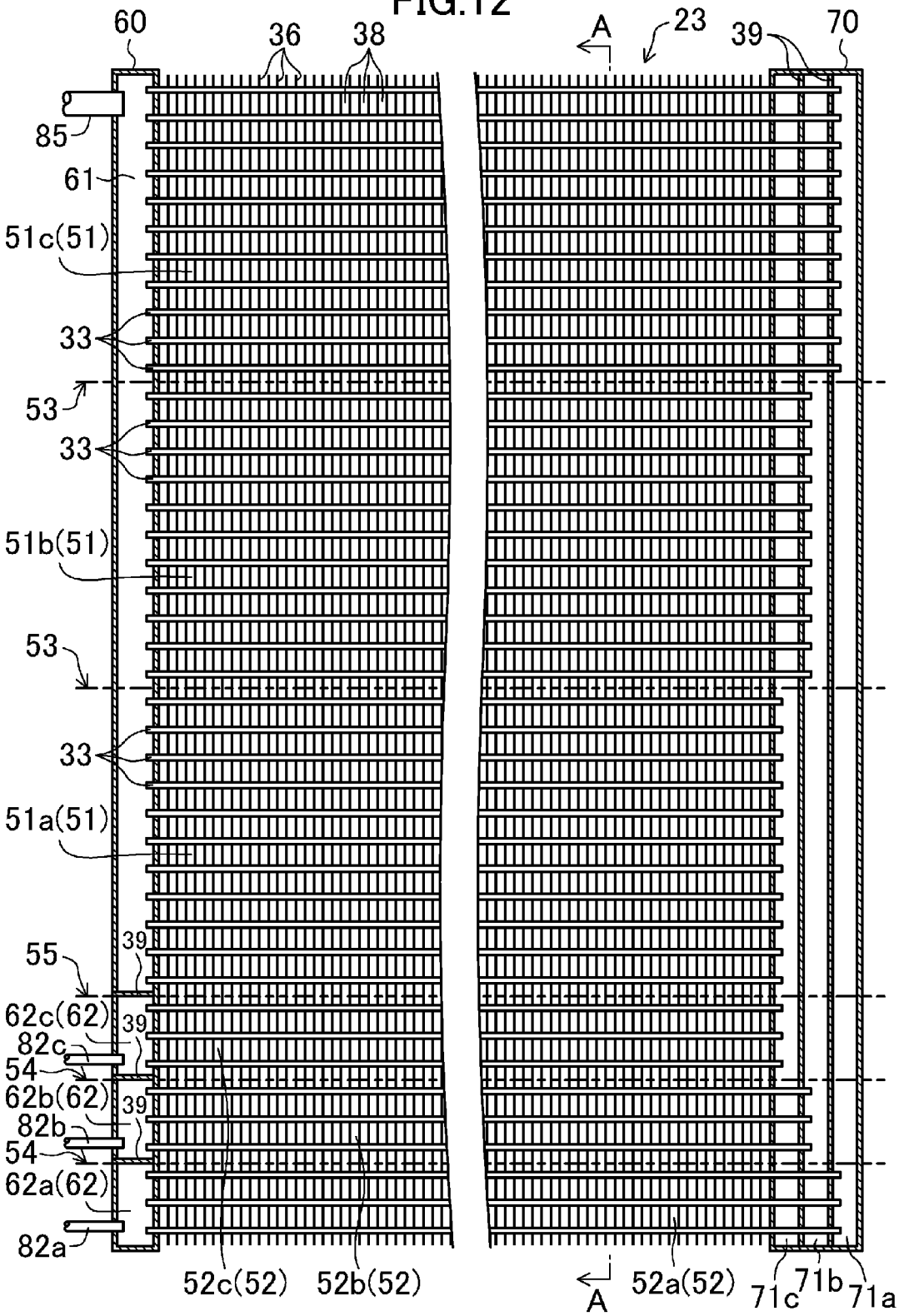
FIG. 12 is a partial cross-sectional view illustrating a front side of the outdoor heat exchanger of the third embodiment.

Referring to FIG. 12, an internal space of the second header collecting pipe (70) of the outdoor heat exchanger (23) is vertically divided into three communication spaces (71*a*-71*c*) by two partition plates (39). Specifically, in the internal space of the second header collecting pipe (70), the first communication space (71*a*), the second communication space (71*b*), and the third communication space (71*c*) are formed in this order from the right side as viewed in FIG. 12. The first communication space (71*a*) communicates with flat tubes (33) of a third main heat exchange part (51*c*) and flat tubes (33) of a first auxiliary heat exchange part (52*a*). The second communication space (71*b*) communicates with flat tubes (33) of a second main heat exchange part (51*b*) and flat tubes (33) of a second auxiliary heat exchange part (52*b*). The third communication space (71*c*) communicates with flat tubes (33) of a first main heat exchange part (51*a*) and flat tubes (33) of a third auxiliary heat exchange part (52*c*). In the outdoor heat exchanger (23), the third main heat exchange part (51*c*) and the first auxiliary heat exchange part (52*a*) are paired together, the second main heat exchange part (51*b*) and the second auxiliary heat exchange part (52*b*) are paired together, and the first main heat exchange part (51*a*) and the third auxiliary heat exchange part (52*c*) are paired together.

That is, in the second header collecting pipe (70) of the outdoor heat exchanger (23) of the present embodiment, the main heat exchange part (51*a*-51*c*) of an upper heat exchange region (51) and the auxiliary heat exchange part (52*a*-52*c*) of a lower heat exchange region (52) are paired together. The communication spaces (71*a*-71*c*) corresponding respectively to the pairs of heat exchange parts (51*a*-51*c*, 52*a*-52*c*) are formed such that the number of communication spaces (71*a*-71*c*) is the same (e.g., three) as the number of pairs of heat exchange parts (51*a*-51*c*, 52*a*-52*c*). As described above, in the second header collecting pipe (70), the flat tubes (33) of the pair of main heat exchange part (51*a*-51*c*) and auxiliary heat exchange part (52*a*-52*c*) directly communicate with each other in the internal space of the second header collecting pipe (70).

In an air-cooling operation, while flowing through fluid passages (34), refrigerant flowing into each of the fluid passages (34) of the flat tubes (33) of the main heat exchange parts (51*a*-51*c*) is, in the outdoor heat exchanger (23), condensed by dissipating heat to outdoor air, and then flows into an associated one of the communication spaces (71*a*-71*c*) of the second header collecting pipe (70). The refrigerant flowing into each of the communication spaces (71*a*-71*c*) is distributed to the flat tubes (33) of an associated one of the auxiliary heat exchange parts (52*a*-52*c*). While flowing through the fluid passages (34), the refrigerant flowing into each of the fluid passages (34) of the flat tubes (33) of the auxiliary heat exchange parts (52*a*-52*c*) enters a subcooled liquid state by dissipating heat to outdoor air. As in the foregoing, in the air-cooling operation, refrigerant flows, in the outdoor heat exchanger (23), into the main heat exchange parts (51*a*-51*c*) of the upper heat exchange region (51), and dissipates heat. Then, the refrigerant flows into the auxiliary heat exchange parts (52*a*-52*c*) of the lower heat exchange region (52), and further dissipates heat.

In an air-heating operation, refrigerant flowing into each of the fluid passages (34) of the flat tubes (33) of the auxiliary heat exchange parts (52*a*-52*c*) flows, in the outdoor heat exchanger (23), through the fluid passage (34), and then flows into an associated one of the first to third communication spaces (71*a*-71*c*) of the second header collecting pipe (70). The refrigerant flowing into each of the communication spaces (71*a*-71*c*) is distributed to the flat tubes (33) of an associated one of the main heat exchange parts (51*a*-51*c*). While flowing through the fluid passages (34), the refrigerant flowing into each of the fluid passages (34) of the flat tubes (33) of the main heat exchange parts (51*a*-51*c*) is evaporated by absorbing heat from outdoor air, and enters a substantially gas single-phase state. The flows of refrigerant are joined together at an upper space (61) of the first header collecting pipe (60). As in the foregoing, in the air-heating operation, refrigerant flows, in the outdoor heat exchanger (23), into the auxiliary heat exchange parts (52*a*-52*c*) of the lower heat exchange region (52). Then, such refrigerant flows into the main heat exchange parts (51*a*-51*c*) of the upper heat exchange region (51), and absorbs heat.

In the outdoor heat exchanger (23) of the present embodiment, the main heat exchange parts (51*a*-51*c*) are arranged so as to be concentrated on one side (upper side) of the outdoor heat exchanger (23) in the vertical direction, and the auxiliary heat exchange parts (52*a*-52*c*) are arranged so as to be concentrated on the opposite side (lower side) of the outdoor heat exchanger (23) in the vertical direction. Thus, as in the first embodiment, the number of parts where the main heat exchange part and the auxiliary heat exchange part are adjacent to each other can be reduced to the minimum of one part. That is, in the outdoor heat exchanger (23) of the present embodiment, the part where the main heat exchange part (51*a*-51*c*) and the auxiliary heat exchange part (52*a*-52*c*) are adjacent to each other is only part where the first main heat exchange part (51*a*) positioned lowermost in the upper heat exchange region (51) and the third auxiliary heat exchange part (52*c*) positioned uppermost in the lower heat exchange region (52) are adjacent to each other. Thus, a heat loss of refrigerant can be reduced as much as possible, and lowering of a heat exchange efficiency can be significantly reduced.

Note that the state in which the second header collecting pipe (70) is partitioned into the communication spaces (71*a*-71*c*) is not limited to the foregoing.

In the outdoor heat exchanger (23) of the present embodiment, a heat transfer reduction structure (57) may be, as in each of the variations of the first embodiment, provided between the flat tubes (33) which are adjacent to each other across a boundary (55) between the first main heat exchange part (51*a*) of the upper heat exchange region (51) and the third auxiliary heat exchange part (52*c*) of the lower heat exchange region (52).

Fourth Embodiment of the Invention

Figure 13:
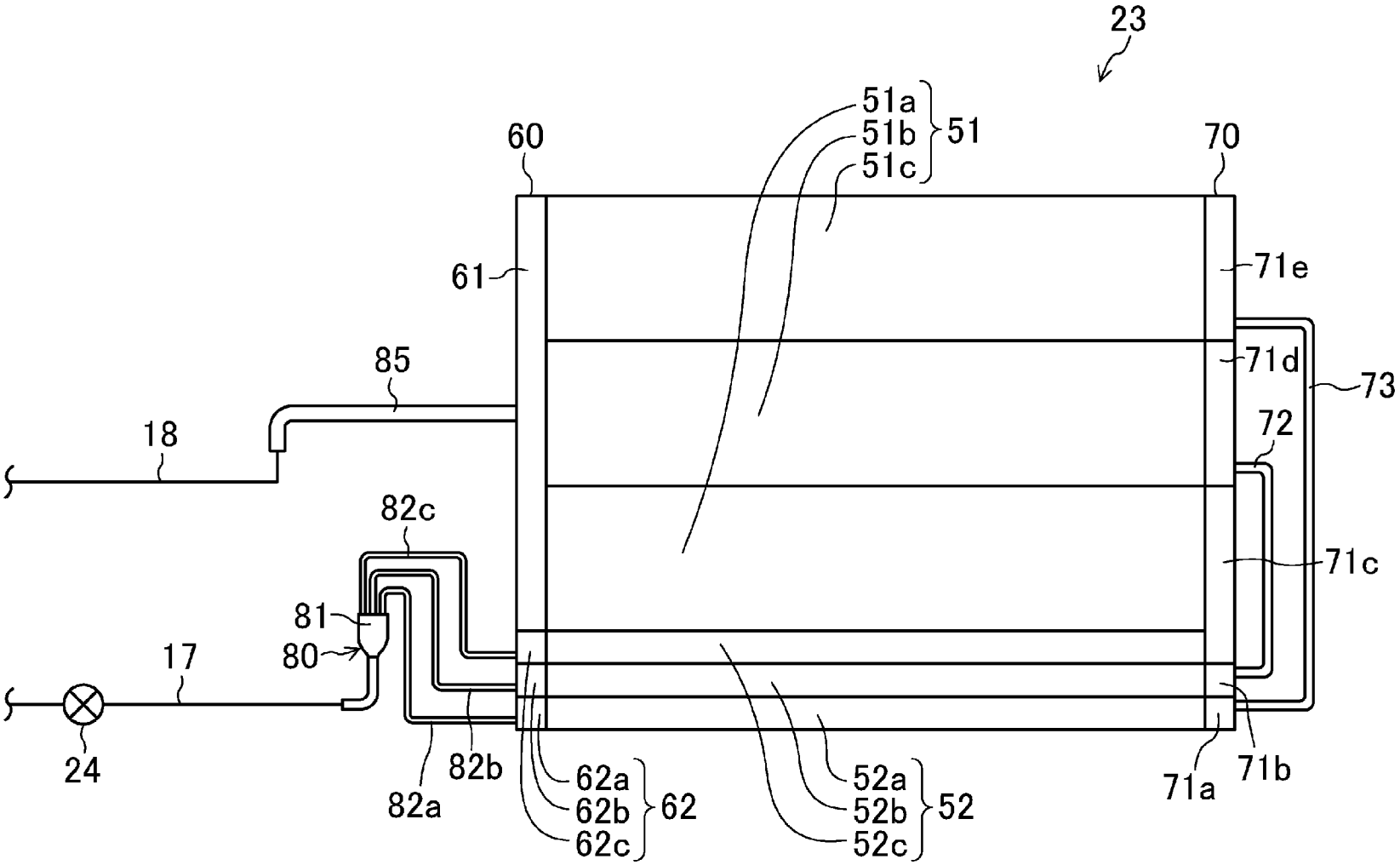
FIG. 13 is a front view illustrating a schematic configuration of an outdoor heat exchanger of a fourth embodiment.
Figure 14:
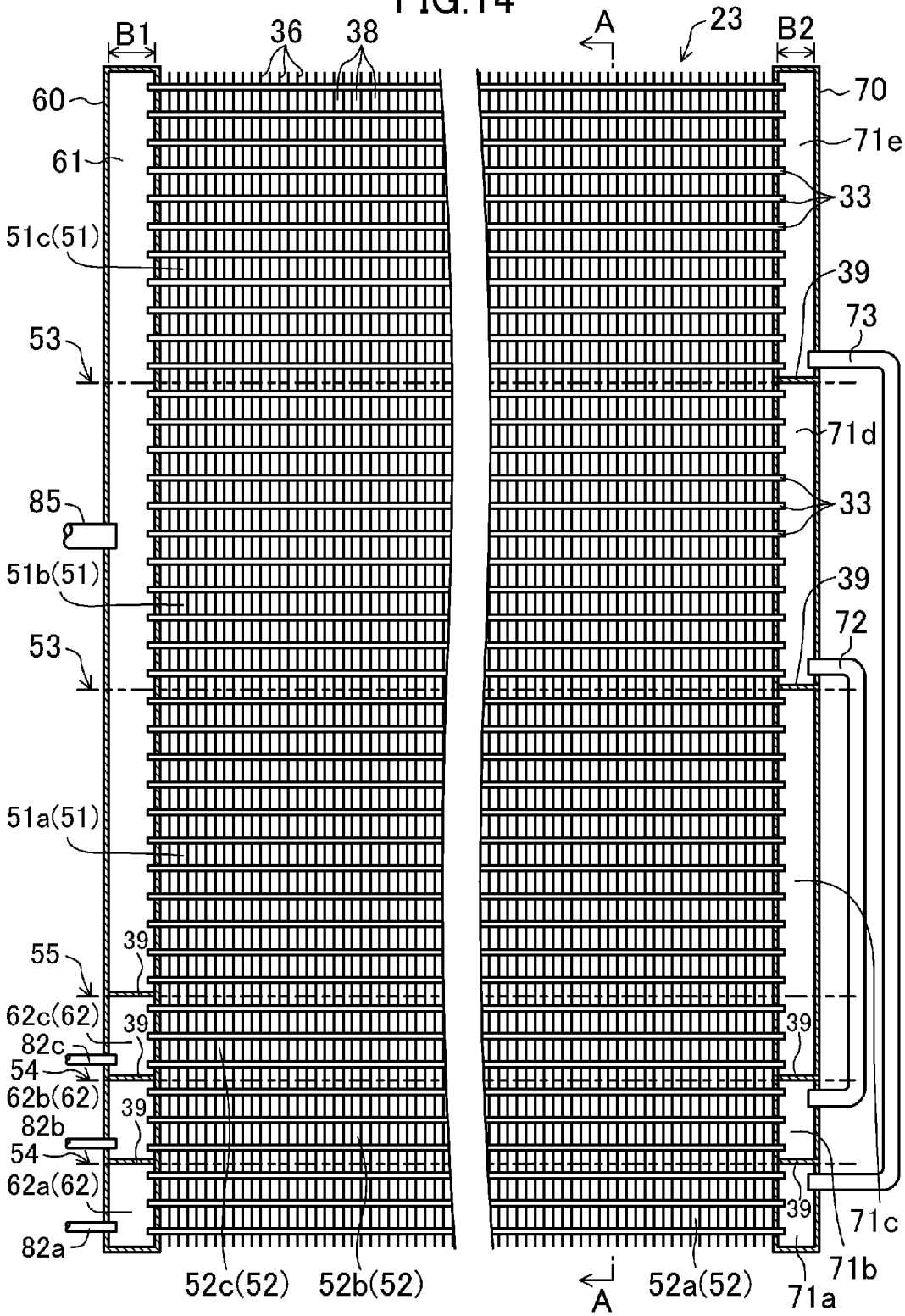
FIG. 14 is a partial cross-sectional view illustrating a front side of the outdoor heat exchanger of the fourth embodiment.

A fourth embodiment of the present disclosure will be described. In the present embodiment, the configuration of the outdoor heat exchanger (23) of the first embodiment is changed. Differences in outdoor heat exchanger (23) between the present embodiment and the first embodiment will be described with reference to FIGS. 13 and 14.

As in the first embodiment, an internal space of a second header collecting pipe (70) of the present embodiment is laterally divided into five communication spaces (71*a*-71*e*). In the second header collecting pipe (70) of the present embodiment, the first communication space (71*a*) and the fifth communication space (71*e*) are paired together, and the second communication space (71*b*) and the fourth communication space (71*d*) are paired together. Moreover, in the second header collecting pipe (70), a first communication pipe (72) connecting between the second communication space (71*b*) and the fourth communication space (71*d*) and a second communication pipe (73) connecting between the first communication space (71*a*) and the fifth communication space (71*e*) are provided. That is, in the outdoor heat exchanger (23) of the present embodiment, a first main heat exchange part (51*a*) and a third auxiliary heat exchange part (52*c*) are paired together, a second main heat exchange part (51*b*) and a second auxiliary heat exchange part (52*b*) are paired together, and a third main heat exchange part (51*c*) and a first auxiliary heat exchange part (52*a*) are paired together.

In the outdoor heat exchanger (23) of the present embodiment, a connection position of a gas connection member (85) in a first header collecting pipe (60) is changed. Specifically, the gas connection member (85) opens at a middle part (i.e., at the middle in the vertical direction) of an upper space (61) of the first header collecting pipe (60). Moreover, referring to FIG. 14, in the outdoor heat exchanger (23) of the present embodiment, the inner diameter B1 of the first header collecting pipe (60) is greater than the inner diameter B2 of the second header collecting pipe (70). Such a configuration allows gas refrigerant flowing into the upper space (61) of the first header collecting pipe (60) from the gas connection member (85) to be equally distributed to the main heat exchange parts (51*a*-51*c*).

In the outdoor heat exchanger (23) of the present embodiment, the inner diameters of the header collecting pipes (60, 70) may be, as in the first embodiment, equal to each other, or the gas connection member (85) may open at part of the upper space (61) close to the upper end thereof in the first header collecting pipe (60).

In the outdoor heat exchanger (23) of the present embodiment, a heat transfer reduction structure (57) may be, as in each of the variations of the first embodiment, provided between flat tubes (33) which are adjacent to each other across a boundary (55) between the first main heat exchange part (51*a*) of an upper heat exchange region (51) and the third auxiliary heat exchange part (52*c*) of a lower heat exchange region (52).

Fifth Embodiment of the Invention

A fifth embodiment of the present disclosure will be described. In the present embodiment, the configuration of the outdoor heat exchanger (23) of the first embodiment is changed. Differences in outdoor heat exchanger (23) between the present embodiment and the first embodiment will be described with reference to FIGS. 15-17.

Figure 15:
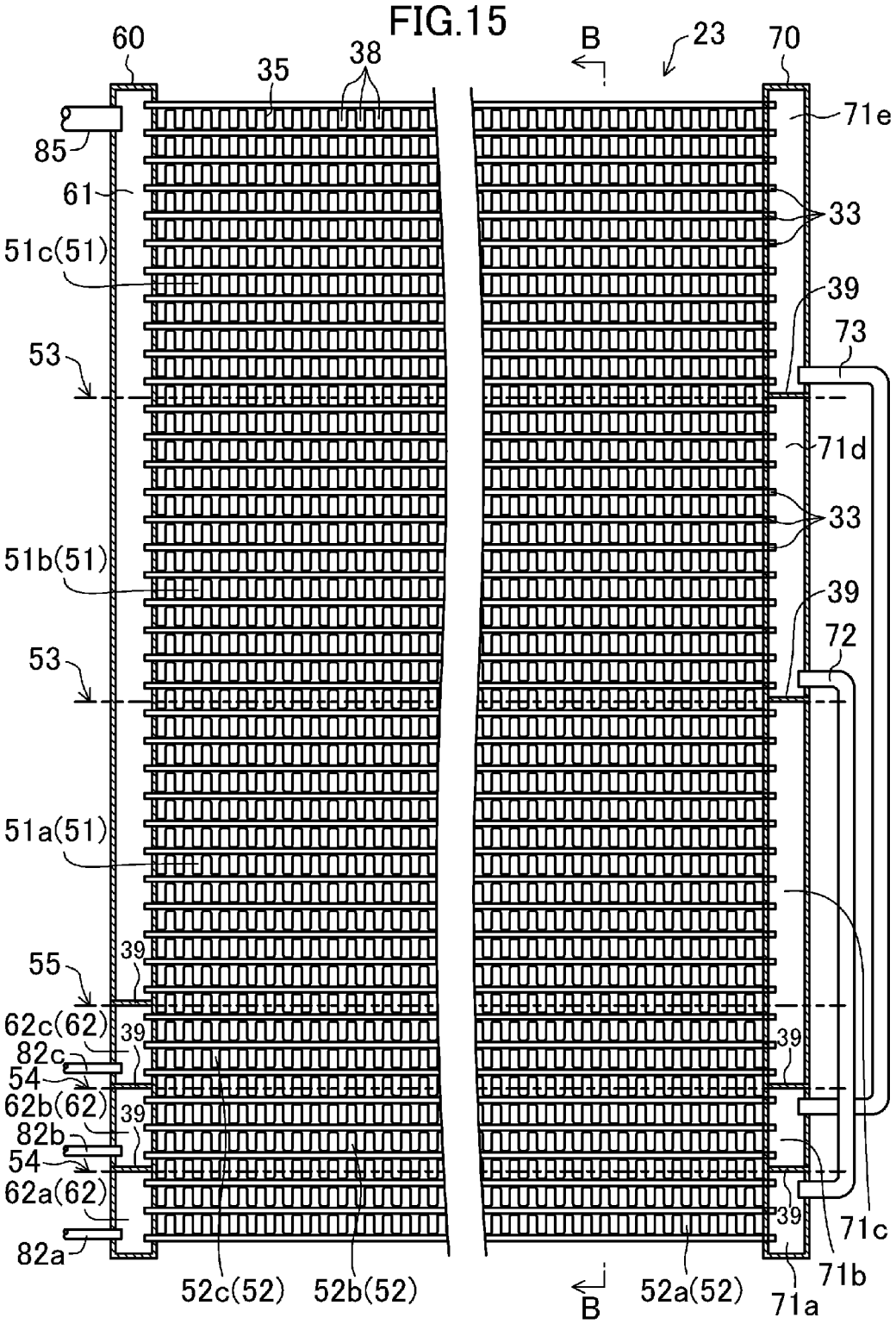
FIG. 15 is a partial cross-sectional view illustrating a front side of an outdoor heat exchanger of a fifth embodiment.
Figure 16:
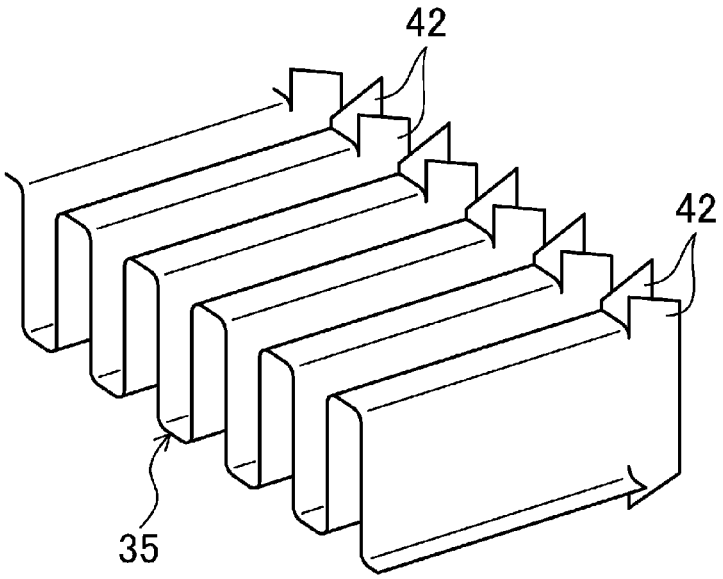
FIG. 16 is a schematic perspective view of a fin of the outdoor heat exchanger of the fifth embodiment.
Figure 17:
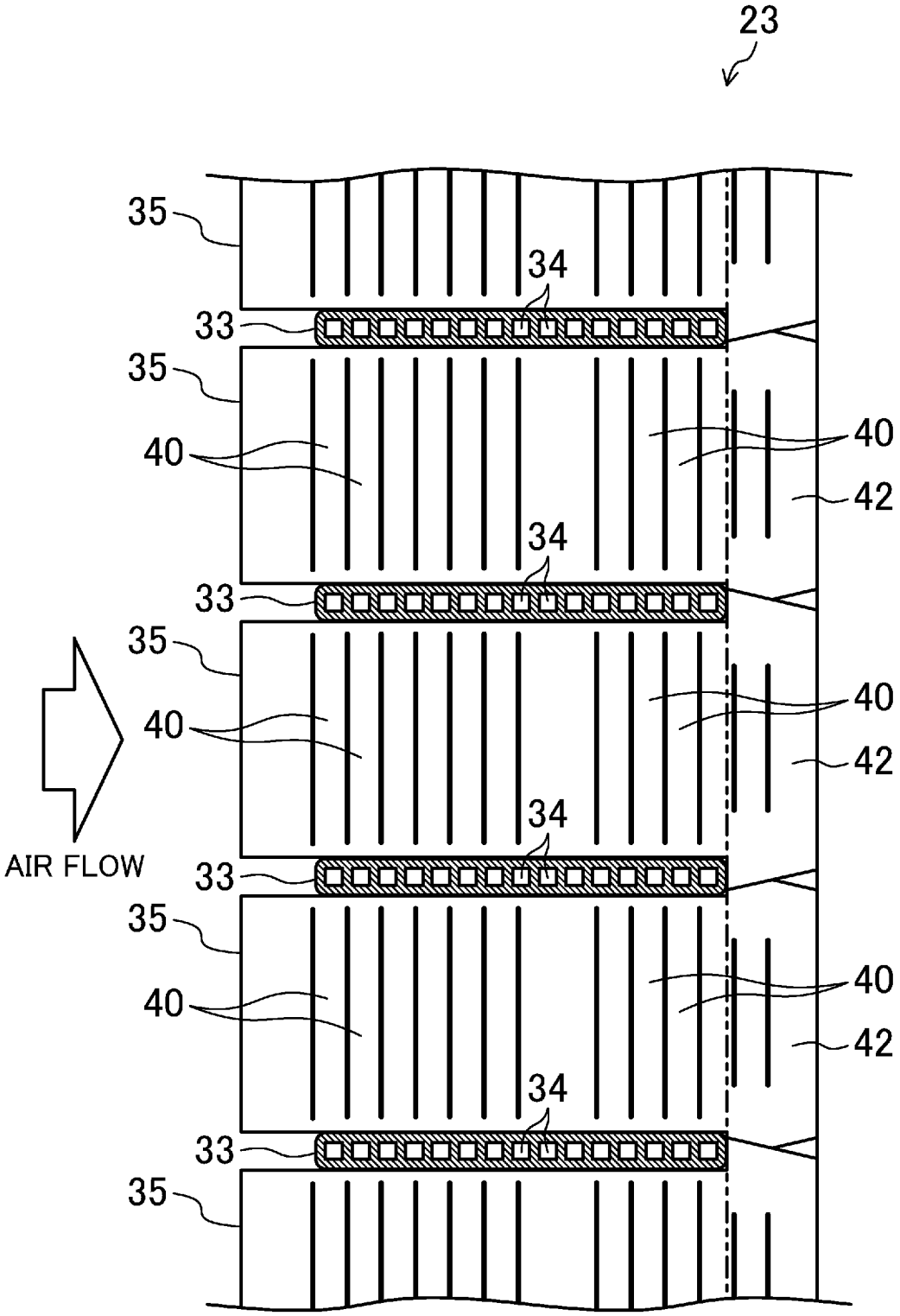
FIG. 17 is a partial cross-sectional view of the heat exchanger along a B-B line illustrated in FIG. 15.

Referring to FIG. 15, in the outdoor heat exchanger (23) of the present embodiment, fins (35) which are corrugated fins are provided instead of the plate-shaped fins (36) of the first embodiment. Referring to FIG. 16, the fin (35) of the present embodiment is in a shape meandering up and down. The fin (35) is arranged between vertically adjacent ones of flat tubes (33), and is joined to flat side surfaces of the flat tubes (33) by brazing. Referring to FIG. 17, louvers (40) each configured to accelerate heat transfer are formed in a vertically-extending flat plate-shaped part of the fin (35).

Referring to FIGS. 16 and 17, in the fin (35), a protruding plate part (42) protruding beyond the flat tube (33) toward a leeward side is formed. The protruding plate part (42) also protrudes upward and downward from the fin (35). Referring to FIG. 17, in the outdoor heat exchanger (23), the protruding plate parts (42) of the fins (35) which are vertically adjacent to each other across the flat tube (33) contact each other. Note that the louvers (40) are not shown in FIG. 16.

In the outdoor heat exchanger (23) of the present embodiment, a heat transfer reduction structure (57) may be, as in each of the variations of the first embodiment, provided between the flat tubes (33) which are vertically adjacent to each other across a boundary (55) between a first main heat exchange part (51*a*) of an upper heat exchange region (51) and a third auxiliary heat exchange part (52*c*) of a lower heat exchange region (52).

INDUSTRIAL APPLICABILITY

As described above, the present disclosure is useful for the heat exchanger in which the plurality of flat tubes are connected to the header collecting pipes, and for the air conditioner including the heat exchanger.

DESCRIPTION OF REFERENCE CHARACTERS

10 Air Conditioner
20 Refrigerant Circuit
23 Outdoor Heat Exchanger (Heat Exchanger)
33 Flat Tube
35 Fin
36 Fin
51 Upper Heat Exchange Region
51*a*, 51*b*, 51*c* Main Heat Exchange Part (Heat Exchange Part)
52 Lower Heat Exchange Region
52*a*, 52*b*, 52*c* Auxiliary Heat Exchange Part (Heat Exchange Part)
55 Boundary
57 Heat Transfer Reduction Structure
60 First Header Collecting Pipe
61 Upper Space
62 Lower Space
62*a*, 62*b*, 62*c* Communication Space
70 Second Header Collecting Pipe
71*a*, 71*b*, 71*c*, 71*d*, 71*e* Communication Space
72, 73 Communication Pipe
75 Communication Member
80, 86 Liquid Connection Member
85 Gas Connection Member

The invention claimed is:

1. A heat exchanger comprising:
a standing first header collecting pipe and a standing second header collecting pipe;
a plurality of flat tubes which are arranged one above the other, which are each connected to the first header collecting pipe at one end and connected to the second header collecting pipe at the other end, and which are each formed with a passage of refrigerant; and
a plurality of fins each configured to divide part of the heat exchanger between adjacent ones of the flat tubes into a plurality of air passages through each of which air flows, wherein
the flat tubes are divided for
an upper heat exchange region divided into a plurality of heat exchange parts stacked adjacent to each other, each of the plurality of heat exchange parts including a number of said plurality of flat tubes, and
a lower heat exchange region divided into a plurality of heat exchange parts stacked adjacent to each the other, each of the plurality of heat exchange parts including a number of said plurality of flat tubes,
an internal space of the first header collecting pipe is divided into
an upper space which is for gas refrigerant and which corresponds to the upper heat exchange region,
a lower space which is for liquid refrigerant and which corresponds to the lower heat exchange region, and
a plurality of communication spaces, in the lower space of the first header collecting pipe, each of the plurality of communication spaces corresponding to a respective one of the plurality of heat exchange parts in the lower region,
an internal space of the second header collecting pipe is divided into
a plurality of communication spaces, each of the plurality of communication spaces corresponding to a respective one of the heat exchange parts of the upper heat exchange region, and
a plurality of communication spaces, each of the plurality of communication spaces corresponding to a respective one of the plurality of heat exchange parts of the lower heat exchange region, and
each communication space of the second header collecting pipe corresponding to the upper heat exchange region communicates with an associated one of the plurality of communication spaces of the second header collecting pipe corresponding to the lower heat exchange region, wherein the number of flat tubes connected to a communication space of the second header collecting pipe corresponding to the upper heat exchange region is larger than the number of flat tubes connected with the associated one of the plurality of communication spaces of the second header collecting pipe corresponding to the lower heat exchange region with which it communicates.

2. The heat exchanger of claim 1, further comprising:
one or more communication pipes, each communication pipe arranged to connect a respective one of the plurality of communication spaces corresponding to a respective one of the plurality of heat exchange parts of the upper heat exchange region in the second header collecting pipe with a respective one of the plurality of communication spaces corresponding to a respective one of the plurality of heat exchange parts of the lower heat exchange region in the second header collecting pipe, wherein
the communication space corresponding to the lowermost one of the heat exchange parts of the upper heat exchange region and the communication space corresponding to the uppermost one of the heat exchange parts of the lower heat exchange region in the second header collecting pipe are directly connected with each other.

3. The heat exchanger of claim 1, wherein
the upper space of the first header collecting pipe is a single space corresponding to all of the heat exchange parts of the upper heat exchange region, and
in the first header collecting pipe, a gas connection member connected to the upper space at a position close to an upper end of the upper space and a liquid connection member connected to each of the plurality of communication spaces of the lower space at a position close to a lower end of the each communication space.

4. The heat exchanger of claim 1, wherein a heat transfer reduction structure configured to reduce heat transfer from one of adjacent ones of the flat tubes to the other one of the adjacent ones of the flat tubes is provided between the adjacent ones of the flat tubes which are adjacent to each other across a boundary between the heat exchange parts of the upper heat exchange region and the lower heat exchange region.

5. An air conditioner comprising:

a refrigerant circuit including a heat exchanger, wherein refrigerant circulates through the refrigerant circuit to perform a refrigeration cycle and the heat exchanger includes a standing first header collecting pipe and a standing second header collecting pipe;

a plurality of flat tubes which are arranged one above the other, which are each connected to the first header collecting pipe at one end and connected to the second header collecting pipe at the other end, and which are each formed with a passage of refrigerant; and a plurality of fins each configured to divide part of the heat exchanger between adjacent ones of the flat tubes into a plurality of air passages through each of which air flows, wherein the flat tubes are divided for an upper heat exchange region divided into a plurality of heat exchange parts stacked adjacent to each other, and a lower heat exchange region divided into a plurality of heat exchange parts stacked adjacent to each the other, an internal space of the first header collecting pipe includes a plurality of partition plates dividing it into an upper space which is for gas refrigerant and which corresponds to the upper heat exchange region, a lower space which is for liquid refrigerant and which corresponds to the lower heat exchange region, and a plurality of communication spaces, in the lower space of the first header collecting pipe, each of the plurality of communication spaces corresponding to a respectively one of the plurality of heat exchange parts in the lower region, an internal space of the second header collecting pipe includes a plurality of partition plates dividing it into a plurality of communication spaces, each of the plurality of communication spaces corresponding to a respective one of the heat exchange parts of the upper heat exchange region, and a plurality of communication spaces, each of the plurality of communication spaces corresponding to a respective one of the plurality of heat exchange parts of the lower heat exchange region, and each communication space of the second header collecting pipe corresponding to the upper heat exchange region communicates with an associated one of the plurality of communication spaces of the second header collecting pipe corresponding to the lower heat exchange region, wherein the number of flat tubes connected to a communication space of the second header collecting piper corresponding to the upper heat exchange region is larger than the number of flat tubes connected with the associated one of the plurality of communication spaces of the second header collecting pipe corresponding to the lower heat exchange region with which it communicates.

6. The heat exchanger of claim 2, wherein the upper space of the first header collecting pipe is a single space corresponding to all of the heat exchange parts of the upper heat exchange region, and in the first header collecting pipe, a gas connection member connected to the upper space at a position close to an upper end of the upper space and a liquid connection member connected to each of the plurality of communication spaces of the lower space at a position close to a lower end of the each communication space.

7. The heat exchanger of claim 2, wherein a heat transfer reduction structure configured to reduce heat transfer from one of adjacent ones of the flat tubes to the other one of the adjacent ones of the flat tubes is provided between the adjacent ones of the flat tubes which are adjacent to each other across a boundary between the heat exchange parts of the upper heat exchange region and the lower heat exchange region.

8. The heat exchanger of claim 3, wherein a heat transfer reduction structure configured to reduce heat transfer from one of adjacent ones of the flat tubes to the other one of the adjacent ones of the flat tubes is provided between the adjacent ones of the flat tubes which are adjacent to each other across a boundary between the heat exchange parts of the upper heat exchange region and the lower heat exchange region.

9. The heat exchanger of claim 6, wherein a heat transfer reduction structure configured to reduce heat transfer from one of adjacent ones of the flat tubes to the other one of the adjacent ones of the flat tubes is provided between the adjacent ones of the flat tubes which are adjacent to each other across a boundary between the heat exchange parts of the upper heat exchange region and the lower heat exchange region.

* * * * *